US011283147B2

(12) United States Patent
Ashida et al.

(10) Patent No.: US 11,283,147 B2
(45) Date of Patent: Mar. 22, 2022

(54) DIRECTIONAL COUPLER

(71) Applicant: TDK CORPORATION, Tokyo (JP)

(72) Inventors: Yuta Ashida, Tokyo (JP); Masahiro Tatematsu, Tokyo (JP); Shuhei Sawaguchi, Tokyo (JP); Shigemitsu Tomaki, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 17/155,789

(22) Filed: Jan. 22, 2021

(65) Prior Publication Data

US 2021/0234249 A1 Jul. 29, 2021

(30) Foreign Application Priority Data

Jan. 27, 2020 (JP) ..... JP2020-010864

(51) Int. Cl.
*H01P 5/18* (2006.01)

(52) U.S. Cl.
CPC ..... *H01P 5/184* (2013.01)

(58) Field of Classification Search
CPC ..... H01P 5/18; H01P 5/184; H01P 5/185
See application file for complete search history.

(56) References Cited

U.S. PATENT DOCUMENTS 5,521,563 A * 5/1996 Mazzochette ..... H01P 5/187 333/116
5,689,217 A * 11/1997 Gu ..... H01P 5/187 333/116
2017/0040661 A1 2/2017 Ashida et al.

FOREIGN PATENT DOCUMENTS

| | | |
|---|---|---|
| CN | 106450641 A | 2/2017 |
| JP | H08-078917 A | 3/1996 |
| JP | H09-116312 A | 5/1997 |
| JP | H09-246818 A | 9/1997 |

OTHER PUBLICATIONS

Translation of Nov. 3, 2021 Office Action issued in Chinese Patent Application No. 202110108472.9.

* cited by examiner

*Primary Examiner* — Dean O Takaoka
(74) *Attorney, Agent, or Firm* — Oliff PLC

(57) ABSTRACT

A directional coupler includes first to fourth terminals, a first line, a second line, a ground conductor portion, and a stack. The first line includes a first center portion, a first connecting portion, and a second connecting portion. The second line includes a second center portion, a third connecting portion, and a fourth connecting portion. A distance between the first and third connecting portions and a distance between the second and fourth connecting portions decrease toward the first and second center portions. The first to fourth terminals are located on a bottom surface of the stack.

10 Claims, 19 Drawing Sheets

DIRECTIONAL COUPLER

BACKGROUND OF THE INVENTION

1. Field of the Invention

The present invention relates to a directional coupler used to detect the levels of transmission and reception signals.

2. Description of the Related Art

The mobile communication systems up to the fourth generation are put to practical use at present. The mobile communication systems up to the fourth generation use frequency bands of 3.6 GHz or lower. The standardization of fifth-generation mobile communication systems is currently ongoing. For the fifth-generation mobile communication systems, the use of frequency bands of 20 GHz or higher, particularly a quasi-millimeter wave band of 20 to 30 GHz and a millimeter wave band of 30 to 300 GHz, is being studied to expand the frequency band.

Among the electric parts used in the communication apparatuses is a directional coupler that is used to detect the levels of transmission and reception signals. A directional coupler configured as follows is known as a conventional directional coupler. The directional coupler has an input port, an output port, a coupling port, a terminal port, a main line, and a subline. One end of the main line is connected to the input port, and the other end of the main line is connected to the output port. One end of the subline is connected to the coupling port, and the other end of the subline is connected to the terminal port. The main line and the subline are configured to be electromagnetically coupled to each other. The terminal port is grounded via a terminator having a resistance value of 50Ω, for example. The input port receives a high frequency signal, and the output port outputs the same. The coupling port outputs a coupling signal having a power that depends on the power of the high frequency signal received at the input port. An example of such a directional coupler is described in JP 9-116312 A.

Major parameters indicating the characteristics of directional couplers include coupling. The coupling refers to the ratio of the power of the signal output from the coupling port to the power of the high frequency signal input to the input port. To suppress power loss of the high frequency signal passing through the main line and prevent the function of the directional coupler to detect the transmission and reception signal levels from being impaired, the directional coupler is designed so that the value of the coupling in the use frequency band falls within a predetermined range.

Among methods for suppressing changes in the coupling over a wide frequency band is one for gradually reducing the distance between the main line and the subline. JP 8-78917 A and JP 9-246818 A disclose a directional coupler in which a plurality of line portions are serially connected stepwise to gradually reduce the distance between the main line and the subline. JP 8-78917 also discloses a directional coupler in which the main line and the subline are formed in an arch shape to gradually reduce the distance between the main line and the subline.

In general, the coupling varies depending on the frequency of the high frequency signal input to the input port. To implement a directional coupler usable in high frequency bands of 20 GHz or higher to be used for the fifth-generation mobile communication system, contrivances are needed to bring the value of the coupling in the use frequency band into a predetermined range. However, such contrivances have not heretofore been fully explored.

SUMMARY OF THE INVENTION

An object of the present invention is to provide a directional coupler usable in a high frequency band.

A directional coupler according to the present invention includes a first terminal, a second terminal, a third terminal, a fourth terminal, a first line that connects the first and second terminals, a second line that connects the third and fourth terminals, a ground conductor portion that is connected to a ground, and a stack for integrating the first to fourth terminals, the first and second lines, and the ground conductor portion. The stack includes a plurality of dielectric layers and a plurality of conductor layers stacked on each other, and includes a top surface and a bottom surface located at opposite ends in a stacking direction of the plurality of dielectric layers and the plurality of conductor layers. The first and second lines are constituted by using the plurality of conductor layers so that the first and second lines are electromagnetically coupled to each other.

The first line includes a first center portion including a longitudinal center of the first line, a first connecting portion connecting the first center portion and the first terminal, and a second connecting portion connecting the first center portion and the second terminal. The second line includes a second center portion including a longitudinal center of the second line, a third connecting portion connecting the second center portion and the third terminal, and a fourth connecting portion connecting the second center portion and the fourth terminal. The second center portion, the third connecting portion, and the fourth connecting portion are opposed to the first center portion, the first connecting portion, and the second connecting portion, respectively, in a first direction orthogonal to the stacking direction. The first and second center portions are located at a same position in the stacking direction. A distance between the first and third connecting portions in the first direction and a distance between the second and fourth connecting portions in the first direction decrease toward the first and second center portions.

The ground conductor portion is located closer to the bottom surface of the stack than the first and second center portions are, where the ground conductor portion overlaps the first and second center portions when seen in the stacking direction. The first to fourth terminals are located on the bottom surface of the stack.

In the directional coupler according to the present invention, a distance between the first connecting portion and an imaginary straight line in the first direction and a distance between the second connecting portion and the imaginary straight line in the first direction may decrease toward the first center portion. The imaginary straight line is assumed to be orthogonal to the stacking direction and the first direction and extend to pass between the first and second center portions. In such a case, a distance between the third connecting portion and the imaginary straight line in the first direction and a distance between the fourth connecting portion and the imaginary straight line in the first direction may decrease toward the second center portion.

In the directional coupler according to the present invention, the stack may further include a ground conductor layer located inside the stack. The ground conductor portion may be constituted by the ground conductor layer. In such a case, at least a part of each of the first to fourth connecting portions may be located closer to the bottom surface of the stack than the first and second center portions are. Each of the first to fourth connecting portions may include a plurality of parts located at respective different positions in the stacking direction.

The directional coupler according to the present invention may further include a ground terminal located on the bottom surface of the stack. The ground conductor portion may be constituted by the ground terminal. In such a case, the first to fourth connecting portions may be located at a same position as that of the first and second center portions in the stacking direction.

In the directional coupler according to the present invention, a distance between the bottom surface of the stack and the ground conductor portion in the stacking direction may fall within a range of 0 to 100 μm.

In the directional coupler according to the present invention, the stack may further include an adjustment conductor layer capacitively coupled to the first and second center portions.

In the directional coupler according to the present invention, the distance between the first and third connecting portions and the distance between the second and fourth connecting portions decrease toward the first and second center portions. Moreover, in the present invention, the first to fourth terminals are located on the bottom surface of the stack. According to the present invention, a directional coupler usable in a high frequency band can thus be implemented.

Other and further objects, features and advantages of the present invention will appear more fully from the following description.

DETAILED DESCRIPTION OF THE PREFERRED EMBODIMENTS

First Embodiment

Figure 1:
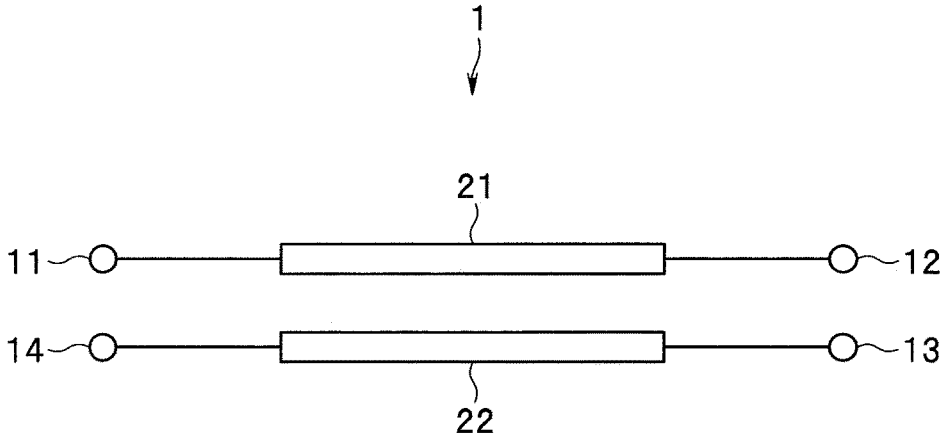
FIG. 1 is a circuit diagram showing the circuit configuration of a directional coupler according to a first embodiment of the invention.

Preferred embodiments of the present invention will now be described in detail with reference to the drawings. First, reference is made to FIG. 1 to describe the circuit configuration of a directional coupler according to a first embodiment of the invention. FIG. 1 is a circuit diagram showing the circuit configuration of the directional coupler according to the first embodiment. As shown in FIG. 1, a directional coupler 1 according to the present embodiment includes a first terminal 11, a second terminal 12, a third terminal 13, a fourth terminal 14, a first line 21 connecting the first and second terminals 11 and 12, and a second line 22 connecting the third and fourth terminals 13 and 14. The first line 21 and the second line 22 are electromagnetically coupled to each other.

In particular, in the present embodiment, the first terminal 11 is an input port. The second terminal 12 is an output port.

The third terminal 13 is a coupling port. The fourth terminal 14 is a terminal port. The first line 21 is a main line. The second line 22 is a subline. The fourth terminal 14 is grounded via a terminator having a resistance value of, for example, 50Ω. In this case, a high frequency signal is received at the first terminal 11 and output from the second terminal 12. The third terminal 13 outputs a coupling signal having a power that depends on the power of the high frequency signal received at the first terminal 11.

Figure 2:
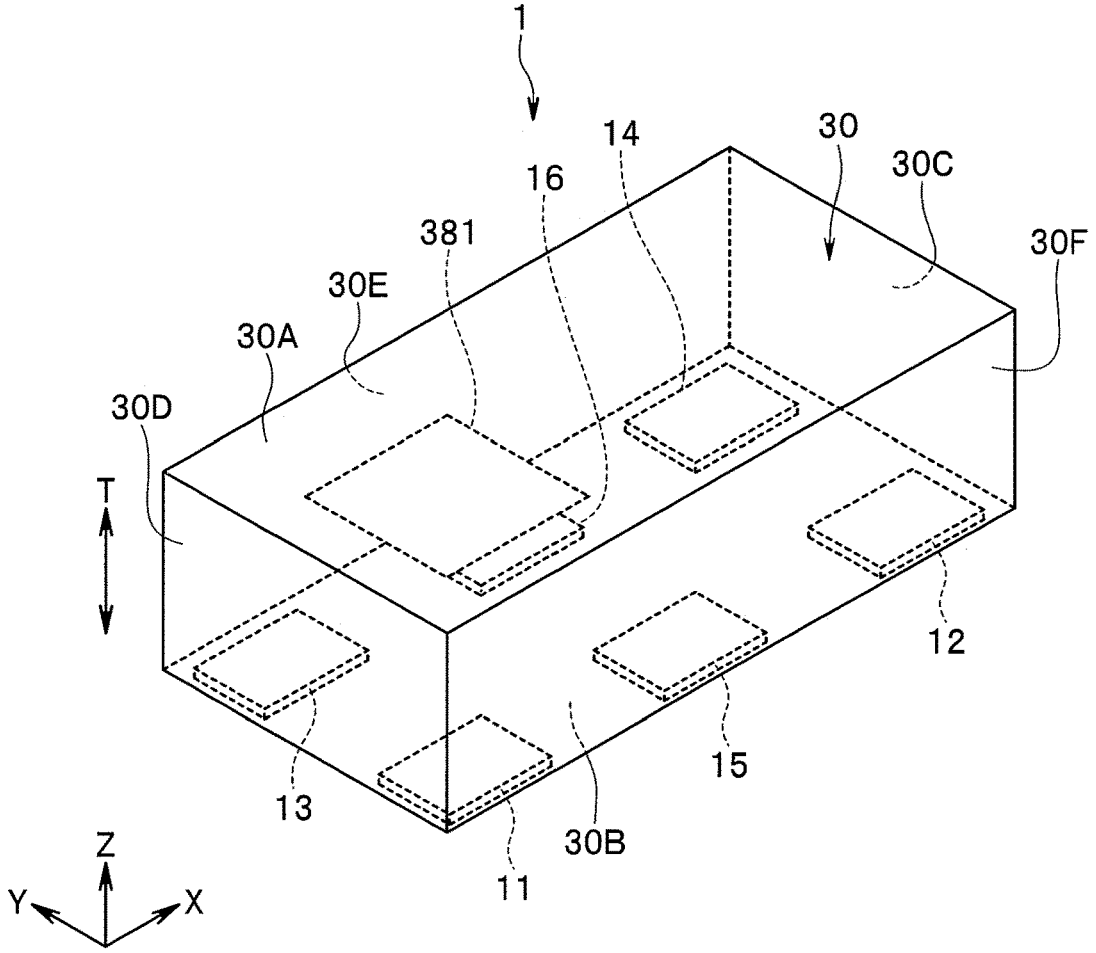
FIG. 2 is a perspective view showing the directional coupler according to the first embodiment of the invention.
Figure 3:
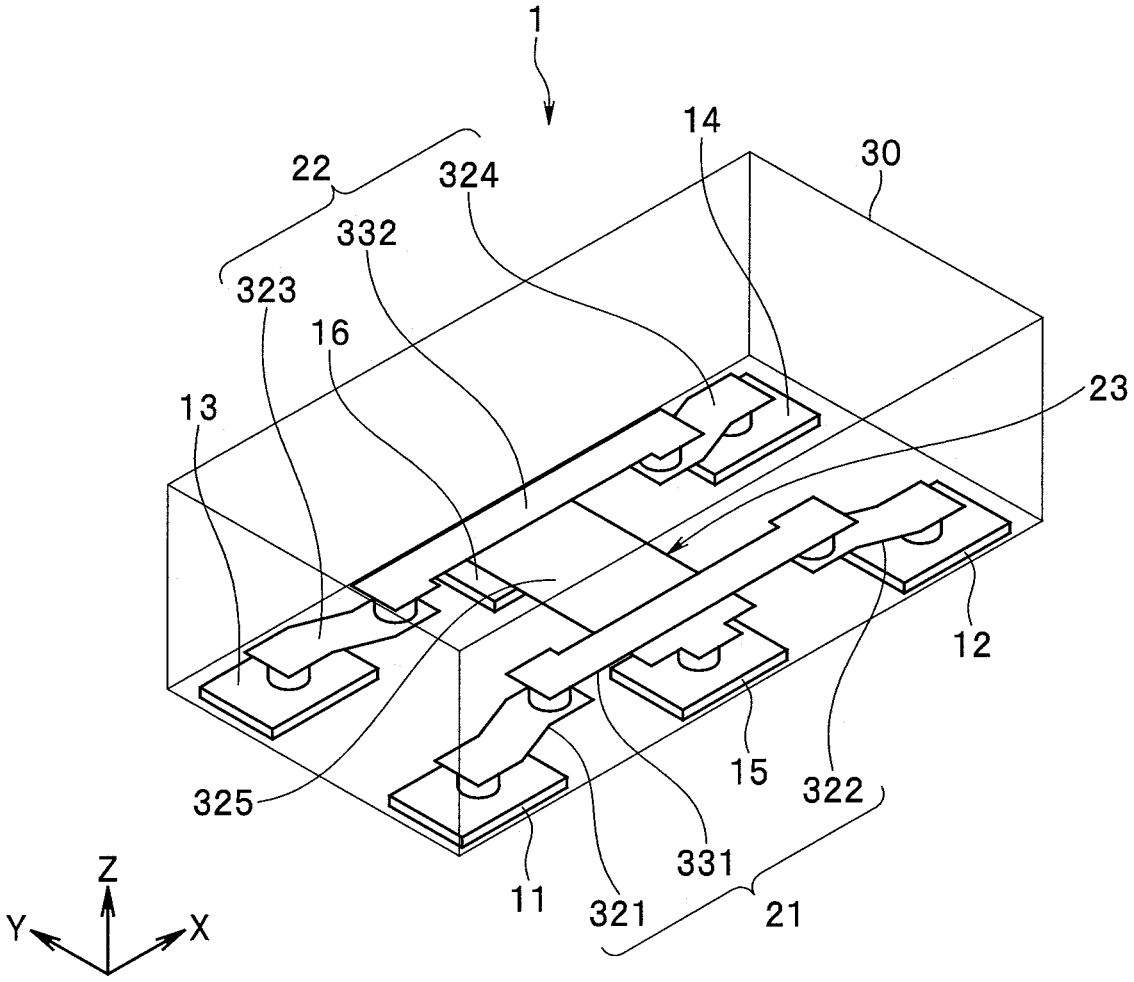
FIG. 3 is a perspective view showing principal parts of the directional coupler according to the first embodiment of the invention.
Figure 4:
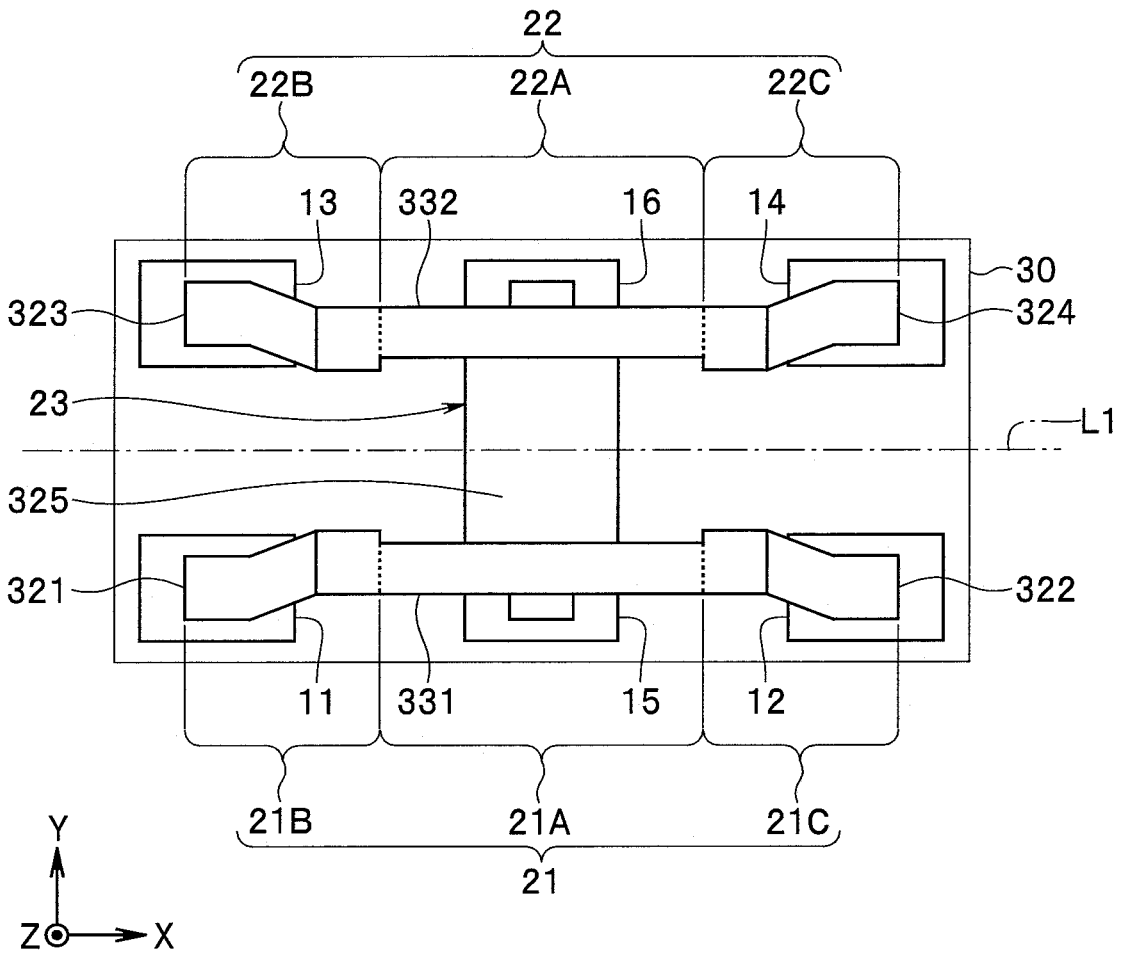
FIG. 4 is a plan view showing principal parts of the directional coupler according to the first embodiment of the invention.

Next, a structure of the directional coupler 1 will be described with reference to FIGS. 2 to 4. FIG. 2 is a perspective view showing the directional coupler 1. FIG. 3 is a perspective view showing principal parts of the directional coupler 1. FIG. 4 is a plan view showing principal parts of the directional coupler 1. The directional coupler 1 further includes a ground conductor portion 23 that is connected to the ground, and a stack 30 for integrating the first to fourth terminals 11 to 14, the first and second lines 21 and 22, and the ground conductor portion 23. As will be described in detail later, the stack 30 includes a plurality of dielectric layers and a plurality of conductor layers stacked on each other. The ground conductor portion 23 is constituted by a conductor layer located inside the stack 30.

The stack 30 is shaped like a rectangular solid. The stack 30 includes a top surface 30A, a bottom surface 30B, and four side surfaces 30C to 30F which constitute the outer periphery of the stack 30. The top surface 30A and the bottom surface 30B are opposite each other. The side surfaces 30C and 30D are opposite each other. The side surfaces 30E and 30F are opposite each other. The side surfaces 30C to 30F are perpendicular to the top surface 30A and the bottom surface 30B. In the stack 30, the dielectric layers and conductor layers are stacked in the direction perpendicular to the top surface 30A and the bottom surface 30B. This direction will be referred to as the stacking direction. The stacking direction is shown by the arrow T in FIG. 2. The top surface 30A and the bottom surface 30B are located at opposite ends in the stacking direction T. FIG. 4 shows the interior of the stack 30 as seen from the top surface 30A side.

Here, X, Y, and Z directions are defined as shown in FIGS. 2 to 4. The X, Y, and Z directions are orthogonal to one another. In the present embodiment, a direction parallel to the stacking direction T will be referred to as the Z direction. In FIG. 4, the X direction is shown as the rightward direction, the Y direction the upward direction, and the Z direction the direction from the far side to the near side of FIG. 4. The opposite directions to the X, Y, and Z directions are defined as −X, −Y, and −Z directions, respectively.

As shown in FIG. 2, the top surface 30A is located at the end of the stack 30 in the Z direction. The bottom surface 30B is located at the end of the stack 30 in the −Z direction. The side surface 30C is located at the end of the stack 30 in the X direction. The side surface 30D is located at the end of the stack 30 in the −X direction. The side surface 30E is located at the end of the stack 30 in the Y direction. The side surface 30F is located at the end of the stack 30 in the −Y direction.

As shown in FIGS. 3 and 4, the ground conductor portion 23 is located to overlap both the first and second lines 21 and 22 when seen in the Z direction. The ground conductor portion 23 generates a capacitance between itself and each of the first and second lines 21 and 22. The capacitance is needed to implement the directional coupler 1.

As shown in FIG. 2, the first to fourth terminals 11 to 14 are provided on the bottom surface 30B of the stack 30. The directional coupler 1 further includes ground terminals 15 and 16 located on the bottom surface 30B of the stack 30. The ground terminals 15 and 16 are connected to the ground. The first terminal 11, the ground terminal 15, and the second terminal 12 are arranged in this order in the X direction at positions closer to the side surface 30F than to the side surface 30E. The third terminal 13, the ground terminal 16, and the fourth terminal 14 are arranged in this order in the X direction at positions closer to the side surface 30E than to the side surface 30F.

Figure 5A:
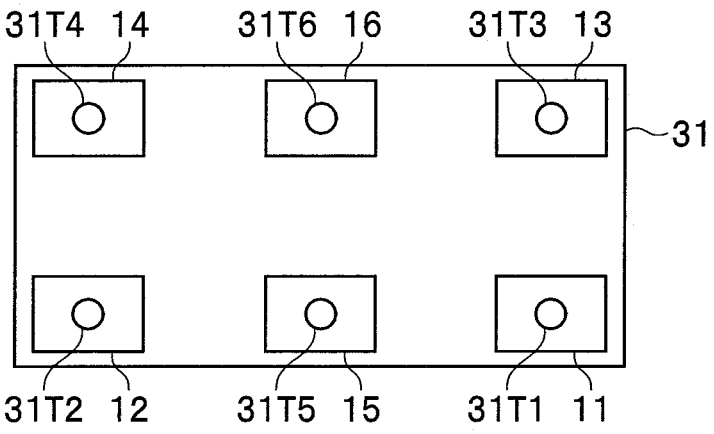
FIG. 5A and FIG. 5B are explanatory diagrams showing the respective patterned surfaces of first and second dielectric layers of a stack included in the directional coupler shown in FIG. 2.
Figure 5B:
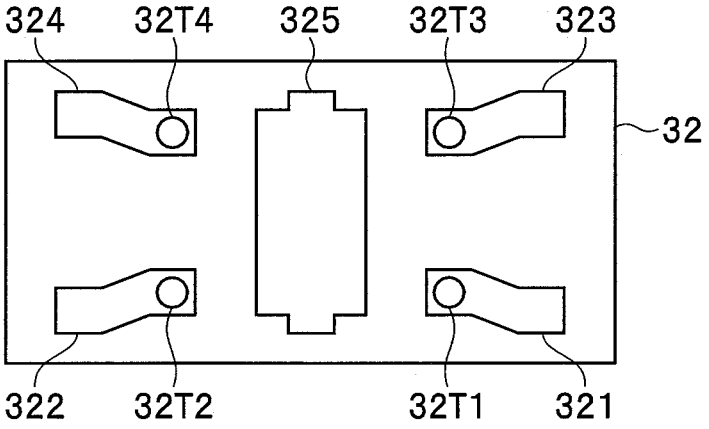
Figure 6A:
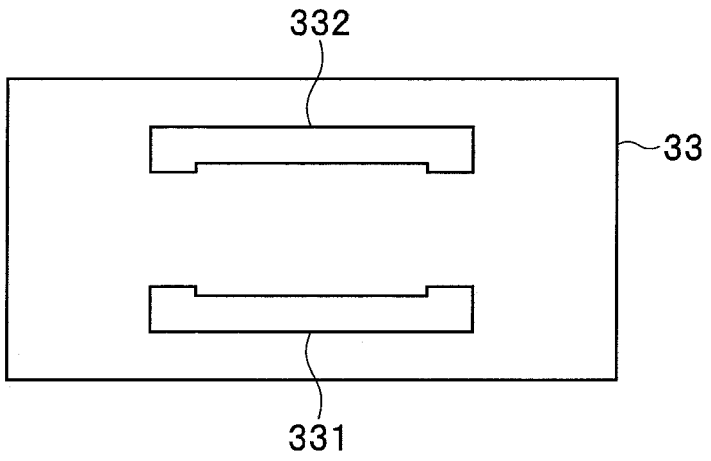
FIG. 6A and FIG. 6B are explanatory diagrams showing the respective patterned surfaces of third and eighth dielectric layers of the stack included in the directional coupler shown in FIG. 2.
Figure 6B:
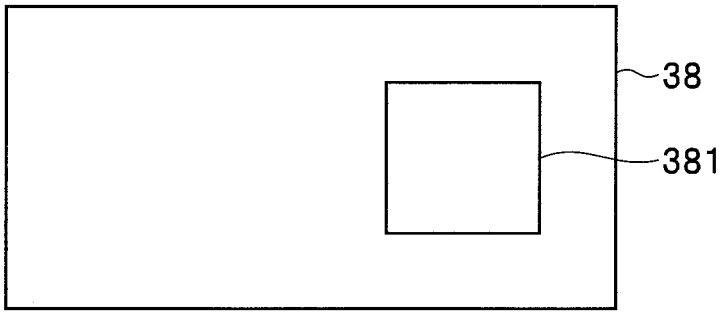

The stack 30 will now be described in detail with reference to FIG. 5A to FIG. 6B. The stack 30 includes eight dielectric layers stacked on top of one another. The eight dielectric layers will be referred to as the first to eighth dielectric layers in the order from bottom to top. The first to eighth dielectric layers will be denoted by the reference numerals 31 to 38. FIG. 5A shows a patterned surface of the first dielectric layer 31. FIG. 5B shows a patterned surface of the second dielectric layer 32. FIG. 6A shows a patterned surface of the third dielectric layer 33. FIG. 6B shows a patterned surface of the eighth dielectric layer 38.

As shown in FIG. 5A, the first to fourth terminals 11, 12, 13, and 14 and the ground terminals 15 and 16 are formed on the patterned surface of the first dielectric layer 31. Further, through holes 31T1, 31T2, 31T3, 31T4, 31T5, and 31T6 are formed in the dielectric layer 31. The through holes 31T1, 31T2, 31T3, 31T4, 31T5, and 31T6 are connected to the terminals 11, 12, 13, 14, 15, and 16, respectively.

As shown in FIG. 5B, conductor layers 321, 322, 323, and 324 and a ground conductor layer 325 are formed on the patterned surface of the second dielectric layer 32. The conductor layers 321 and 322 are used to constitute the first line 21. The conductor layers 323 and 324 are used to constitute the second line 22. The ground conductor layer 325 is used to constitute the ground conductor portion 23. Each of the conductor layers 321 to 324 has a first end and a second end opposite to each other. The through hole 31T1 formed in the first dielectric layer 31 is connected to a portion of the conductor layer 321 near the first end thereof. The through hole 31T2 formed in the dielectric layer 31 is connected to a portion of the conductor layer 322 near the first end thereof. The through hole 31T3 formed in the dielectric layer 31 is connected to a portion of the conductor layer 323 near the first end thereof. The through hole 31T4 formed in the dielectric layer 31 is connected to a portion of the conductor layer 324 near the first end thereof. The through holes 31T5 and 31T6 formed in the dielectric layer 31 are connected to the conductor layer 325.

Through holes 32T1, 32T2, 32T3, and 32T4 are formed in the dielectric layer 32. The through hole 32T1 is connected to a portion of the conductor layer 321 near the second end thereof. The through hole 32T2 is connected to a portion of the conductor layer 322 near the second end thereof. The through hole 32T3 is connected to a portion of the conductor layer 323 near the second end thereof. The through hole 32T4 is connected to a portion of the conductor layer 324 near the second end thereof.

As shown in FIG. 6A, conductor layers 331 and 332 are formed on the patterned surface of the third dielectric layer 33. The conductor layer 331 is used to constitute the first line 21. The conductor layer 332 is used to constitute the second line 22. Each of the conductor layers 331 and 332 has a first end and a second end opposite to each other. The through hole 32T1 formed in the second dielectric layer 32 is connected to a portion of the conductor layer 331 near the first end thereof. The through hole 32T2 formed in the dielectric layer 32 is connected to a portion of the conductor layer 331 near the second end thereof. The through hole 32T3 formed in the dielectric layer 32 is connected to a portion of the conductor layer 332 near the first end thereof. The through hole 32T4 formed in the dielectric layer 32 is connected to a portion of the conductor layer 332 near the second end thereof.

Although not shown in the drawing, no conductor layer or through hole is formed on/in the fourth to seventh dielectric layers 34, 35, 36, and 37.

As shown in FIG. 6B, a mark 381 is formed on the patterned surface of the eighth dielectric layer 38.

The stack 30 shown in FIG. 2 is formed by stacking the first to eighth dielectric layers 31 to 38 such that the patterned surface of the first dielectric layer 31 also serves as the bottom surface 30B of the stack 30.

Correspondences of the components of the directional coupler 1 with the components inside the stack 30 shown in FIG. 5A to FIG. 6B will now be described. The first line 21 is constituted by using the conductor layers 321, 322, and 331. The portion of the conductor layer 331 near the first end thereof is connected to the first terminal 11 via the through hole 32T1, the conductor layer 321, and the through hole 31T1. The portion of the conductor layer 331 near the second end thereof is connected to the second terminal 12 via the through hole 32T2, the conductor layer 322, and the through hole 31T2.

The second line 22 is constituted by using the conductor layers 323, 324, and 332. The portion of the conductor layer 332 near the first end thereof is connected to the third terminal 13 via the through hole 32T3, the conductor layer 323, and the through hole 31T3. The portion of the conductor layer 332 near the second end thereof is connected to the fourth terminal 14 via the through hole 32T4, the conductor layer 324, and the through hole 31T4.

The ground conductor portion 23 is constituted by the ground conductor layer 325. The ground conductor layer 325 is connected to the ground terminal 15 via the through hole 31T5 and connected to the ground terminal 16 via the through hole 31T6.

Next, structural characteristics of the directional coupler 1 will be described. The first and second lines 21 and 22 are constituted by using the conductor layers 321 to 324, 331, and 332 so that the first and second lines 21 and 22 are electromagnetically coupled to each other.

As shown in FIG. 4, the first line 21 includes a first center portion 21A, a first connecting portion 21B, and a second connecting portion 21C. The first center portion 21A includes the longitudinal center of the first line 21. The first connecting portion 21B connects the first center portion 21A and the first terminal 11. The second connecting portion 21C connects the first center portion 21A and the second terminal 12. The first center portion 21A is constituted by the major part of the conductor layer 331. The first connecting portion 21B is constituted by another part of the conductor layer 331 and the conductor layer 321. The second connecting portion 21C is constituted by yet another part of the conductor layer 331 and the conductor layer 322. In FIG. 4, the border between the first center portion 21A and the first connecting portion 21B of the conductor layer 331 and the border between the first center portion 21A and the second connecting portion 21C of the conductor layer 331 are shown by dotted lines.

The first center portion 21A extends in a direction parallel to the X direction that is a straight direction. The first connecting portion 21B is connected to the end of the first center portion 21A in the −X direction. The second connecting portion 21C is connected to the end of the first center portion 21A in the X direction. The first line 21 as a whole extends in the direction parallel to the X direction.

As shown in FIG. 4, the second line 22 includes a second center portion 22A, a third connecting portion 22B, and a fourth connecting portion 22C. The second center portion 22A includes the longitudinal center of the second line 22. The third connecting portion 22B connects the second center portion 22A and the third terminal 13. The fourth connecting portion 22C connects the second center portion 22A and the fourth terminal 14. The second center portion 22A is constituted by the major part of the conductor layer 332. The third connecting portion 22B is constituted by another part of the conductor layer 332 and the conductor layer 323. The fourth connecting portion 22C is constituted by yet another part of the conductor layer 332 and the conductor layer 324. In FIG. 4, the border between the second center portion 22A and the third connecting portion 22B of the conductor layer 332 and the border between the second center portion 22A and the fourth connecting portion 22C of the conductor layer 332 are shown by dotted lines.

The second center portion 22A extends in a direction parallel to the X direction that is a straight direction. The third connecting portion 22B is connected to the end of the second center portion 22A in the −X direction. The fourth connecting portion 22C is connected to the end of the second center portion 22A in the X direction. The second line 22 as a whole extends in the direction parallel to the X direction.

The second center portion 22A, the third connecting portion 22B, and the fourth connecting portion 22C are opposed to the first center portion 21A, the first connecting portion 21B, and the second connecting portion 21C, respectively, in a direction parallel to the Y direction that is a direction orthogonal to the stacking direction T. The conductor layers 323, 324, and 332 are also opposed to the conductor layers 321, 322, and 331, respectively, in the direction parallel to the Y direction.

The first and second center portions 21A and 22A are located at the same position in the stacking direction T. In the present embodiment, both the conductor layer 331 constituting the first center portion 21A and the conductor layer 332 constituting the second center portion 22A are located on the patterned surface of the dielectric layer 33. In the present embodiment, both the first and second center portions 21A and 22A extend in the direction parallel to the X direction. The distance between the first and second center portions 21A and 22A in the direction parallel to the Y direction is constant regardless of the position in the X direction. Each of the first and second center portions 21A and 22B, or each of the conductor layers 331 and 332, may have a length equivalent to ¼ the wavelength corresponding to a predetermined frequency in the use frequency band of the directional coupler 1.

Now, as shown in FIG. 4, assume an imaginary straight line L1 that is parallel to the X direction and extends to pass between the first and second center portions 21A and 22A. With the direction parallel to the Y direction as a first direction, the imaginary straight line L1 is orthogonal to the stacking direction T and the first direction.

The distance between the first connecting portion 21B and the imaginary straight line L1 in the direction parallel to the Y direction and the distance between the second connecting portion 21C and the imaginary straight line L1 in the direction parallel to the Y direction decrease toward the first center portion 21A. The distance between the third connecting portion 22B and the imaginary straight line L1 in the direction parallel to the Y direction and the distance between the fourth connecting portion 22C and the imaginary straight line L1 in the direction parallel to the Y direction decrease toward the second center portion 22A. As a result, the distance between the first and third connecting portions 21B and 22B in the direction parallel to the Y direction and the distance between the second and fourth connecting portions 21C and 22C in the direction parallel to the Y direction decrease toward the first and second center portions 21A and 22A.

The distance between the first connecting portion 21B and the imaginary straight line L1 in the direction parallel to the Y direction and the distance between the second connecting portion 21C and the imaginary straight line L1 in the direction parallel to the Y direction may decrease gradually or change stepwise. In the present embodiment, the closer to the first center portion 21A, the smaller the distance between a part of the first connecting portion 21B and the imaginary straight line L1 in the direction parallel to the Y direction and the distance between a part of the second connecting portion 21C and the imaginary straight line L1 in the direction parallel to the Y direction are. The rest of the first connecting portion 21B and the rest of the second connecting portion 21C extend in the direction parallel to the X direction.

Similarly, the distance between the third connecting portion 22B and the imaginary straight line L1 in the direction parallel to the Y direction and the distance between the fourth connecting portion 22C and the imaginary straight line L1 in the direction parallel to the Y direction may decrease gradually or change stepwise. In the present embodiment, the closer to the second center portion 22A, the smaller the distance between a part of the third connecting portion 22B and the imaginary straight line L1 in the direction parallel to the Y direction and the distance between a part of the fourth connecting portion 22C and the imaginary straight line L1 in the direction parallel to the Y direction are. The rest of the third connecting portion 22B and the rest of the fourth connecting portion 22C extend in the direction parallel to the X direction.

In particular, in the example shown in FIGS. 2 and 3, the first line 21 and the second line 22 have a symmetrical shape about an XZ plane including the imaginary straight line L1.

At least a part of each of the first to fourth connecting portions 21B, 21C, 22B, and 22C is located closer to the bottom surface 30B of the stack 30 than the first and second center portions 21A and 22A are. In the present embodiment, the conductor layer 321 constituting a part of the first connecting portion 21B, the conductor layer 322 constituting a part of the second connecting portion 21C, the conductor layer 323 constituting a part of the third connecting portion 22B, and the conductor layer 324 constituting a part of the fourth connecting portion 22C are all located on the patterned surface of the dielectric layer 32. The dielectric layer 32 is located closer to the bottom surface 30B of the stack 30 than the dielectric layer 33 where the conductor layers 331 and 332 constituting the first and second center portions 21A and 22A are located.

As shown in FIGS. 3 and 4, the ground conductor portion 23, i.e., the ground conductor layer 325 is located closer to the bottom surface 30B of the stack 30 than the first and second center portions 21A and 22A are. The ground conductor layer 325 is located to overlap the first and second center portions 21A and 22A when seen in the stacking direction T. The phrase "when seen in the stacking direction T" means being seen in the Z direction or the —Z direction. In the example shown in FIGS. 3 and 4, the ground conductor layer 325 does not overlap the first to fourth connecting portions 21B, 21C, 22B, and 22C when seen in the stacking direction T.

The operation and effects of the directional coupler 1 according to the first embodiment will now be described. In the present embodiment, the first line 21 includes the first center portion 21A, the first connecting portion 21B, and the second connecting portion 21C. The second line 22 includes the second center portion 22A, the third connecting portion 22B, and the fourth connecting portion 22C. The first and second center portions 21A and 22A and the first to fourth connecting portions 21B, 21C, 22B, and 22C have the foregoing structural characteristics. In the present embodiment, the distance between the first and second lines 21 and 22 decreases toward the first and second center portions 21A and 22A. According to the present embodiment, changes in the coupling can thus be suppressed over a wide frequency band.

The coupling is one of the major parameters indicating the characteristics of the directional coupler 1. The coupling refers to the ratio of the power of a signal output from the third terminal 13 that is the coupling port to the power of a high frequency signal input to the first terminal 11 that is the input port. The directional coupler 1 is designed so that the value of the coupling in the use frequency band falls within a predetermined range. Typically, the higher the signal frequency, the higher the capacitive coupling. As a result, the coupling increases. Where coupling is denoted as −c (dB), an increase in coupling means a decrease in the value of c.

In the fifth-generation mobile communication system, the use of frequency bands higher than those used in the mobile communication systems up to the fourth generation, or specifically, frequency bands of 20 GHz or higher are being contemplated. To enable the use of the directional coupler 1 in a high frequency band of 20 GHz or higher, the capacitive coupling needs to be reduced so that the value of the coupling in the use frequency band falls within a predetermined range.

In view of this, in the present embodiment, the first and second center portions 21A and 22A are located at the same position in the stacking direction T. According to the present embodiment, the capacitive coupling between the first and second center portions 21A and 22A can thereby be weakened, compared to a case where the first and second center portions 21A and 22A are opposed to each other in the stacking direction T.

A plurality of terminals can be provided on a stack by locating the plurality of terminals on a side surface of the stack. In such a case, stray capacitance can occur between the main line and subline and the terminals and between the plurality of terminals of the directional coupler. The higher the signal frequency, the higher the capacitive coupling due to the stray capacitance.

By contrast, in the present embodiment, the first to fourth terminals 11 to 14 are located on the bottom surface 30B of the stack 30. According to the present embodiment, the capacitive coupling due to stray capacitance can thus be weakened compared to the case where the terminals are located on a side surface of the stack.

Consequently, according to the present embodiment, the directional coupler 1 can be used in a high frequency band.

An example of characteristics of the directional coupler 1 according to the present embodiment will now be described with reference to FIG. 7 to FIG. 11. Initially, the parameters indicating the characteristics of the directional coupler 1 will be described. Aside from the foregoing coupling, the parameters indicating the characteristics of the directional coupler 1 include isolation, directivity, return loss, and insertion loss.

The definitions of the coupling, isolation, directivity, return loss, and insertion loss will now be described. Initially, the power of a signal reflected at the first terminal 11 when a high frequency signal having power P0 is input to the first terminal 11 that is the input port will be denoted as P1. The power of a signal output from the second terminal 12 that is the output port will be denoted as P2, the power of a signal output from the third terminal 13 that is the coupling port as P3, and the power of a signal output from the fourth terminal 14 that is the terminal port as P4. The power of the signal output from the third terminal 13 when a high frequency signal having power of P02 is input to the second terminal 12 will be denoted as P03. The coupling, isolation, directivity, return loss, and insertion loss will be represented by the symbols C, I, D, RL, and IL, respectively. Such parameters are defined by the following Eqs. (1) to (5):

$$C=10\log(P3/P0) \quad (1)$$

$$I=10\log(P03/P02) \quad (2)$$

$$D=10\log(P4/P3) \quad (3)$$

$$RL=10\log(P1/P0) \quad (4)$$

$$IL=10\log(P2/P0) \quad (5)$$

Figure 7:
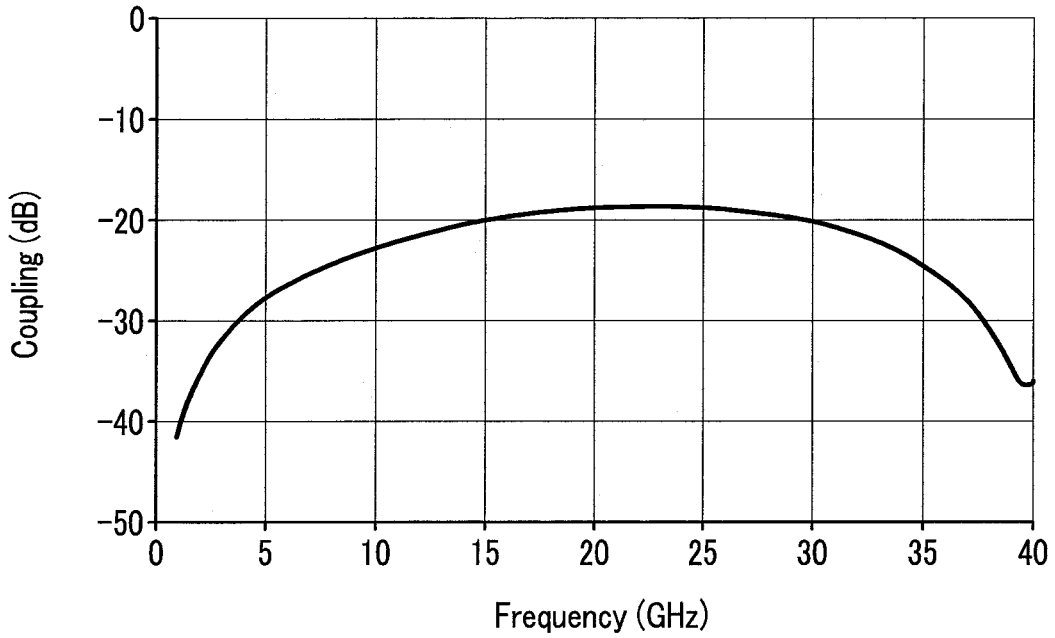
FIG. 7 is a characteristic diagram showing the frequency response of the coupling of the directional coupler according to the first embodiment of the invention.

FIG. 7 is a characteristic diagram showing the frequency response of the coupling of the directional coupler 1. In FIG. 7, the horizontal axis represents frequency, and the vertical axis represents coupling. FIG. 7 indicates that the directional coupler 1 exhibits a sufficiently small change in the coupling in response to a change in frequency in the 24.25 to 29.5 GHz frequency band. Where the coupling is denoted as −c (dB), the value of c is preferably 15 or more and not more than 21. As shown in FIG. 7, the value of c of the directional coupler 1 in the 24.25 to 29.5 GH frequency band falls within the range of 15 or more and not more than 21.

Figure 8:
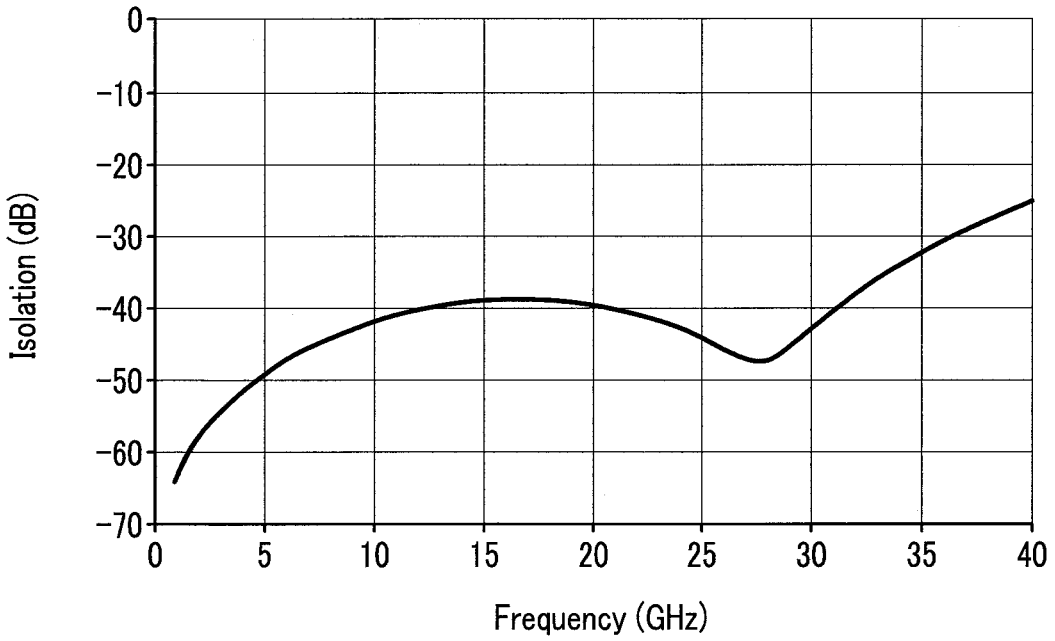
FIG. 8 is a characteristic diagram showing the frequency response of the isolation of the directional coupler according to the first embodiment of the invention.

FIG. 8 is a characteristic diagram illustrating the frequency response of the isolation of the directional coupler 1. In FIG. 8, the horizontal axis represents frequency, and the vertical axis represents isolation. Where the isolation is denoted as −i (dB), the value of i is preferably 31 or more. As shown in FIG. 8, the value of i of the directional coupler 1 in the 24.25 to 29.5 GHz frequency band is 31 or more.

Figure 9:
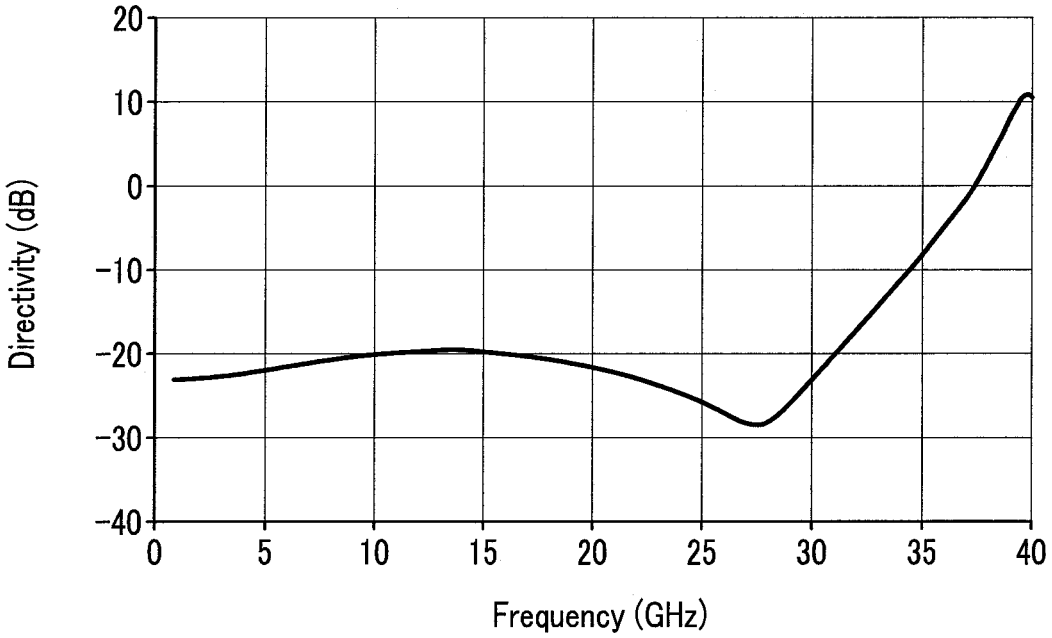
FIG. 9 is a characteristic diagram showing the frequency response of the directivity of the directional coupler according to the first embodiment of the invention.

FIG. 9 is a characteristic diagram showing the frequency response of the directivity of the directional coupler 1. In FIG. 9, the horizontal axis represents frequency, and the vertical axis represents directivity. Preferable values of the directivity will be described later.

Figure 10:
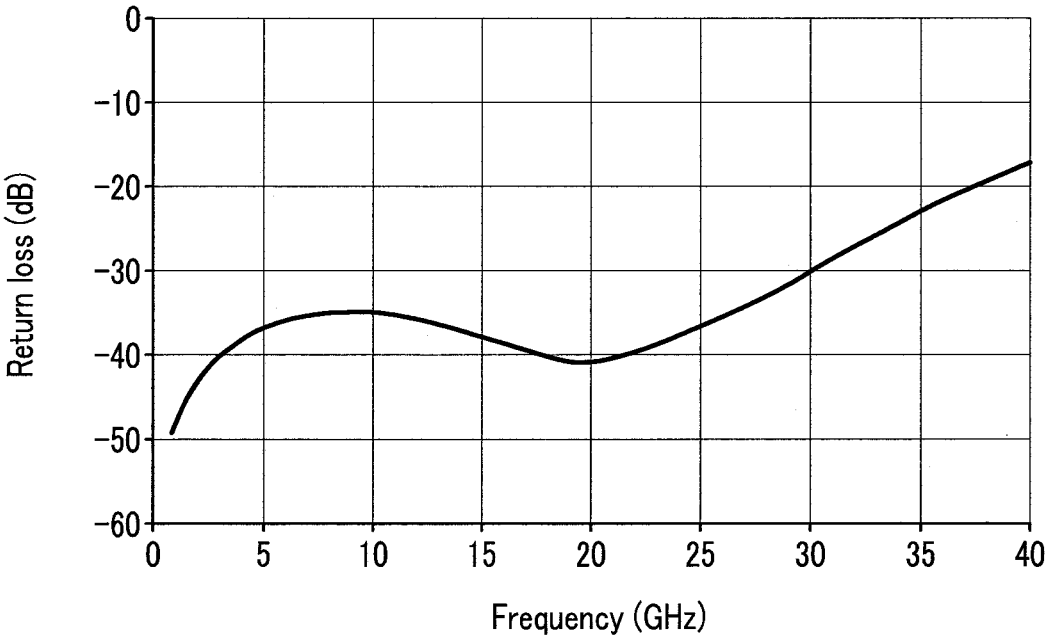
FIG. 10 is a characteristic diagram showing the frequency response of the return loss of the directional coupler according to the first embodiment of the invention.

FIG. 10 is a characteristic diagram illustrating the frequency response of the return loss of the directional coupler 1. In FIG. 10, the horizontal axis represents frequency, and the vertical axis represents return loss. Where the return loss is denoted as −r (dB), the value of r is preferably 10 or more. As shown in FIG. 10, the value of r of the directional coupler 1 in the 24.25 to 29.5 GHz frequency band is 10 or more.

Figure 11:
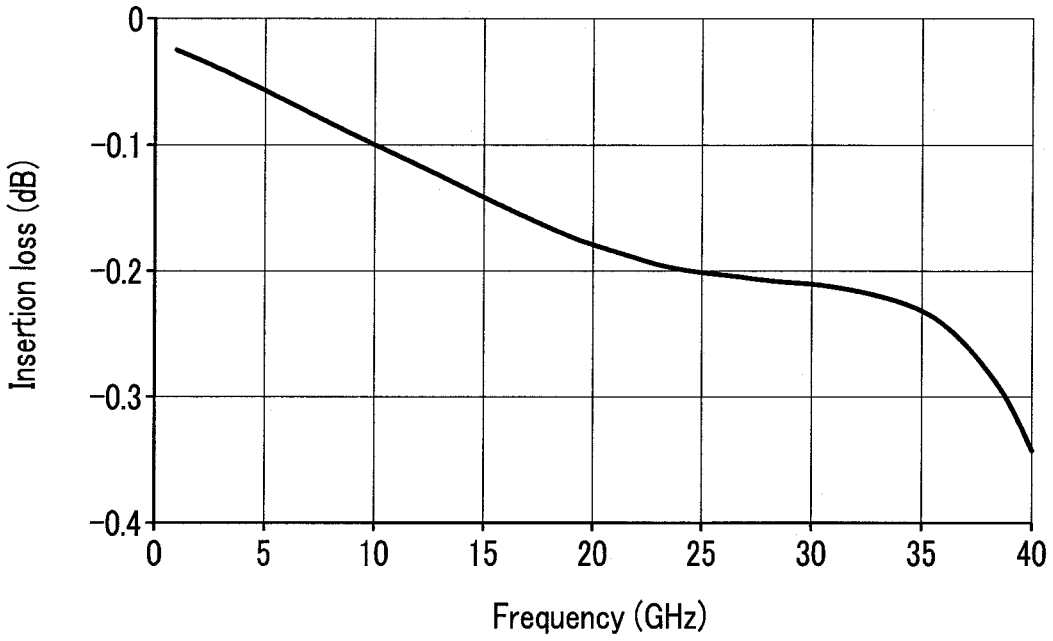
FIG. 11 is a characteristic diagram showing the frequency response of the insertion loss of the directional coupler according to the first embodiment of the invention.

FIG. 11 is a characteristic diagram illustrating the frequency response of the insertion loss of the directional coupler 1. In FIG. 11, the horizontal axis represents frequency, and the vertical axis represents insertion loss. Where the insertion loss is denoted as −x (dB), the value of x is preferably 1.0 or less. As shown in FIG. 11, the value of x of the directional coupler 1 in the 24.25 to 29.5 GHz frequency band is 1.0 or less.

The directional coupler 1 having the characteristics shown in FIG. 7 to FIG. 11 is usable over a wide frequency band of at least 24.25 to 29.5 GHz. The use frequency band of the directional coupler 1 is thus set to 24.25 to 29.5 GHz, for example.

If the use frequency band is 24.25 to 29.5 GHz, the value of d at 29.5 GHz is preferably 10 or more, where the directivity is denoted as −d (dB). As shown in FIG. 9, the value of d of the directional coupler 1 at 29.5 GHz is 10 or more.

Second Embodiment

Figure 12:
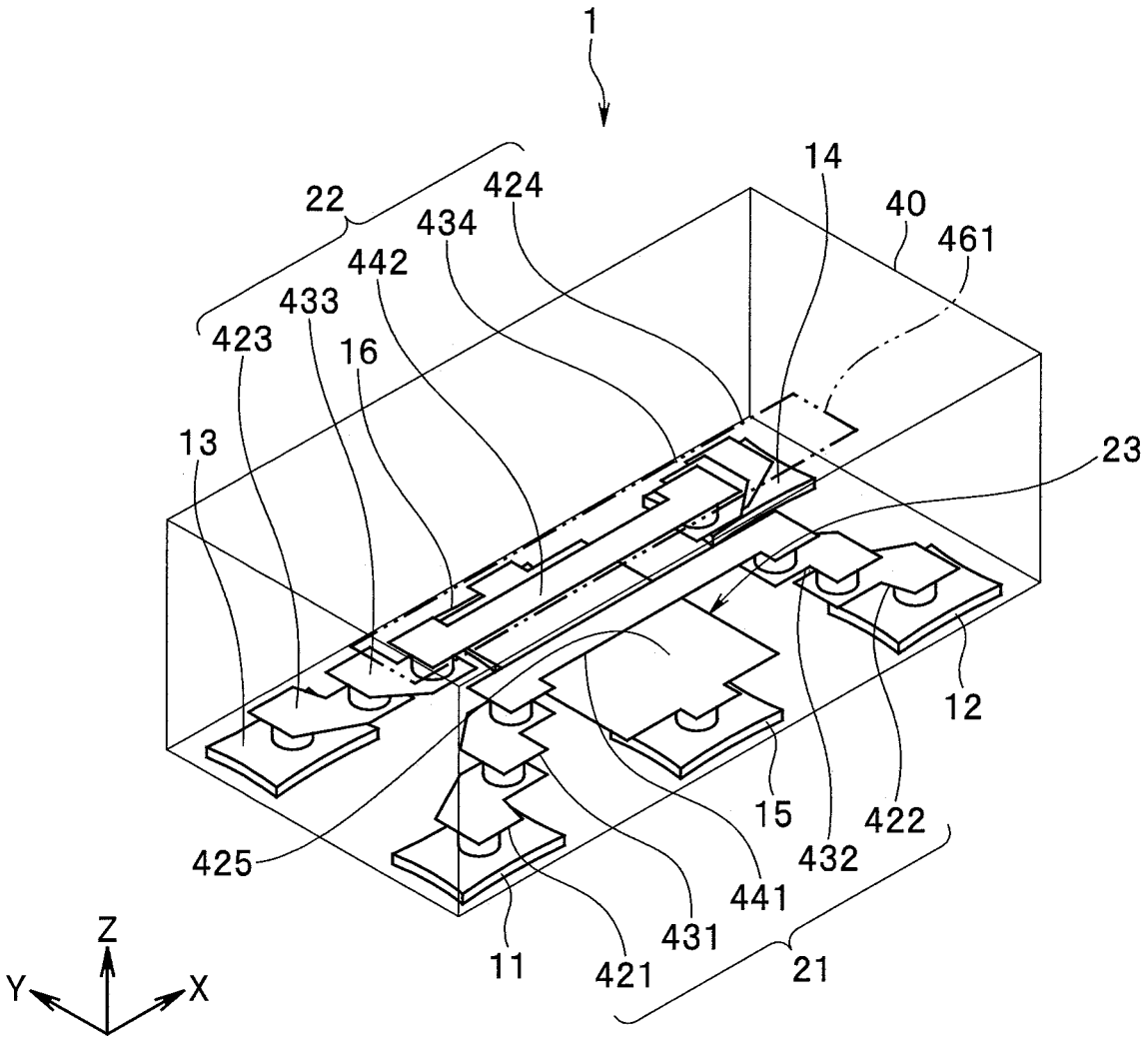
FIG. 12 is a perspective view showing principal parts of the directional coupler according to a second embodiment of the invention.
Figure 13:
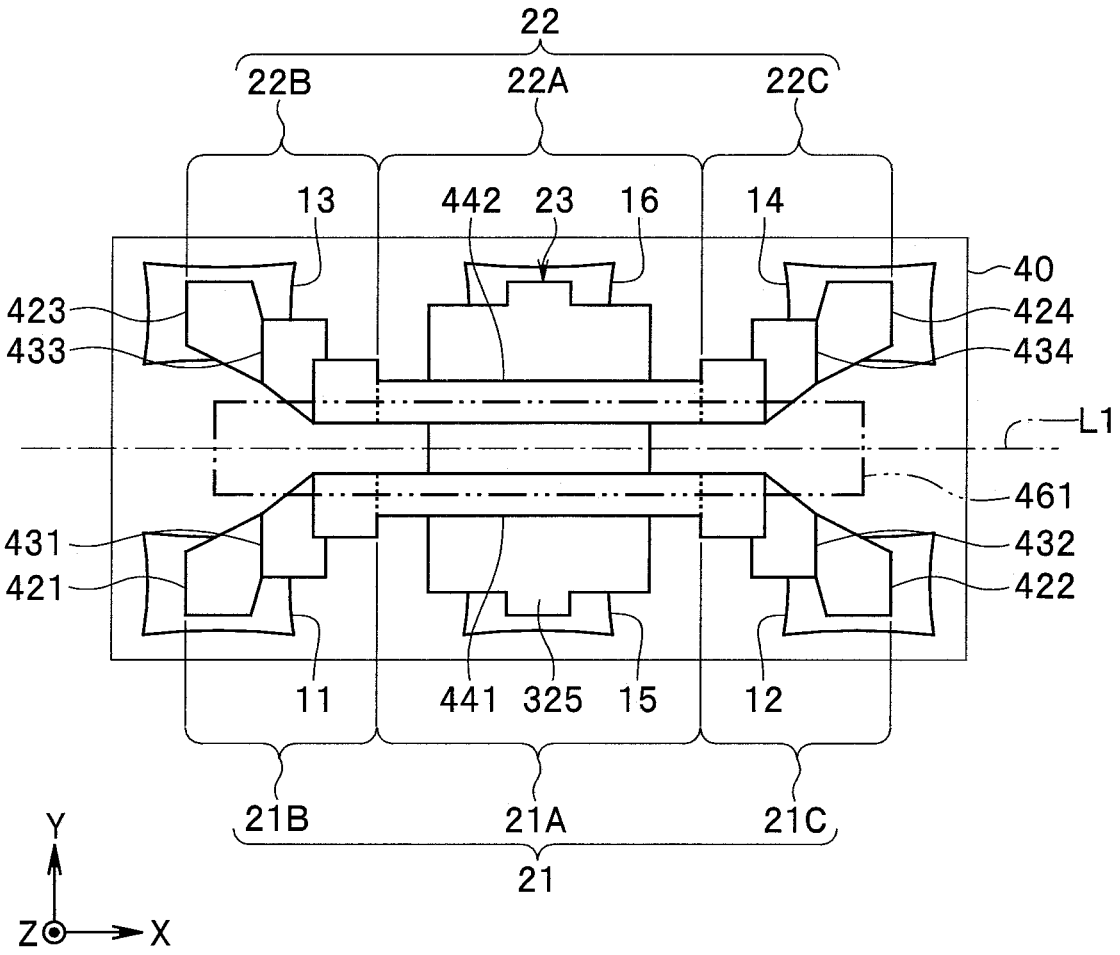
FIG. 13 is a plan view showing principal parts of the directional coupler according to the second embodiment of the invention.

A second embodiment of the invention will now be described. First, reference is made to FIG. 12 and FIG. 13 to describe the configuration of a directional coupler according to the present embodiment. FIG. 12 is a perspective view showing principal parts of the directional coupler according to the present embodiment. FIG. 13 is a plan view showing principal parts of the directional coupler according to the present embodiment.

Like the first embodiment, the directional coupler 1 according to the present embodiment includes first to fourth terminals 11 to 14, ground terminals 15 and 16, a first line 21, a second line 22, and a ground conductor portion 23. The directional coupler 1 according to the present embodiment also includes a stack 40 instead of the stack 30 of the first embodiment. The stack 40 is intended to integrate the first to fourth terminals 11 to 14, the first line 21, the second line 22, and the ground conductor portion 23. The stack 40 includes a plurality of dielectric layers and a plurality of conductor layers stacked on each other.

The stack 40 is shaped like a rectangular solid. Like the stack 30 of the first embodiment, the stack 40 includes a top surface, a bottom surface, and four side surfaces which constitute the outer periphery of the stack 40. The position relationship among the top surface, the bottom surface, and the four side surfaces of the stack 40 is the same as that among the top surface 30A, the bottom surface 30B, and the four side surfaces 30C to 30F of the stack 30. FIG. 13 shows the interior of the stack 40 as seen from the top surface side. The stacking direction of the plurality of dielectric layers and the plurality of conductor layers of the stack 40 will hereinafter be denoted by the symbol T.

The first to fourth terminals 11 to 14 and the ground terminals 15 and 16 are located on the bottom surface of the stack 40. The arrangement of the terminals 11 to 16 on the bottom surface of the stack 40 is the same as that of the terminals 11 to 16 on the bottom surface 30B of the stack 30 described in the first embodiment.

The stack 40 further includes an adjustment conductor layer 461 that is capacitively coupled to the first center portion 21A of the first line 21 and the second center portion 22A of the second line 22. In FIGS. 12 and 13, the adjustment conductor layer 461 is shown by a two-dotted dashed line. In the example shown in FIGS. 12 and 13, the adjustment conductor layer 461 has a shape long in a direction parallel to the X direction. The adjustment conductor layer 461 is located farther from the bottom surface of the stack 40 than the first and second center portions 21A and 22A are, and where the adjustment conductor layer 461 overlaps the first and second center portions 21A and 22A when seen in the stacking direction T.

According to the present embodiment, the strength of the electromagnetic coupling between the first and second lines 21 and 22 can be adjusted by the adjustment conductor layer 461. According to the present embodiment, the coupling of the directional coupler 1 can thus be adjusted.

Note that the adjustment conductor layer 461 does not necessarily need to overlap the first and second center portions 21A and 22A when seen in the stacking direction T. The adjustment conductor layer 461 may overlap either one of the first and second center portions 21A and 22A. The position of the adjustment conductor layer 461 in the stacking direction T is not limited to the example shown in FIG. 12, and may be freely set.

Figure 14A:
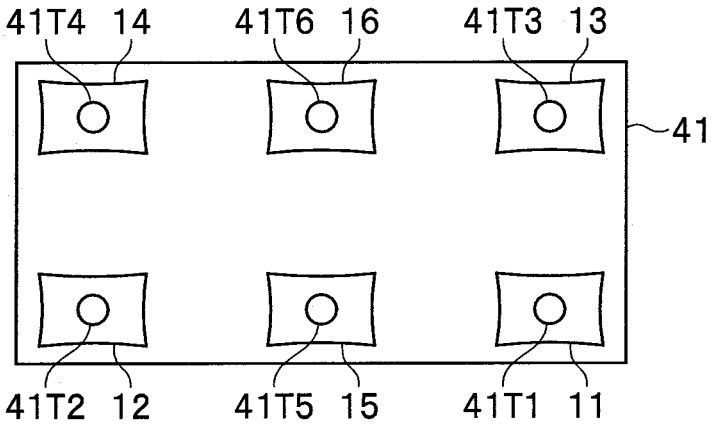
FIG. 14A and FIG. 14B are explanatory diagrams showing the respective patterned surfaces of first and second dielectric layers of a stack included in the directional coupler according to the second embodiment of the invention.
Figure 14B:
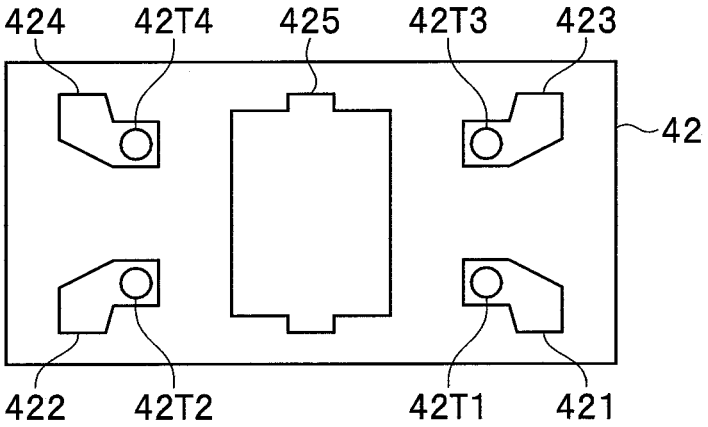
Figure 15A:
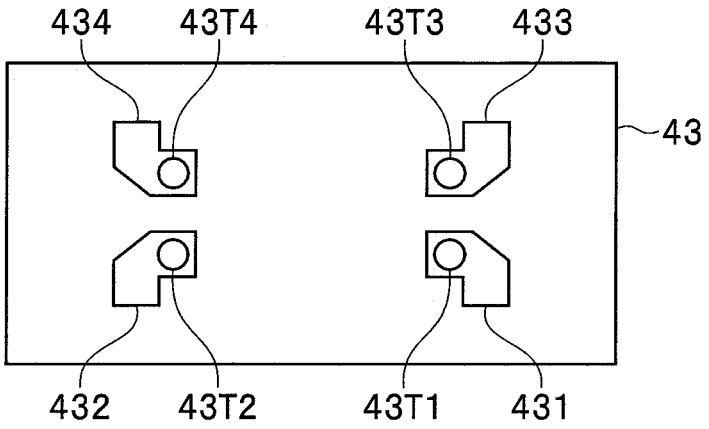
FIG. 15A and FIG. 15B are explanatory diagrams showing the respective patterned surfaces of third and fourth dielectric layers of the stack included in the directional coupler according to the second embodiment of the invention.
Figure 15B:
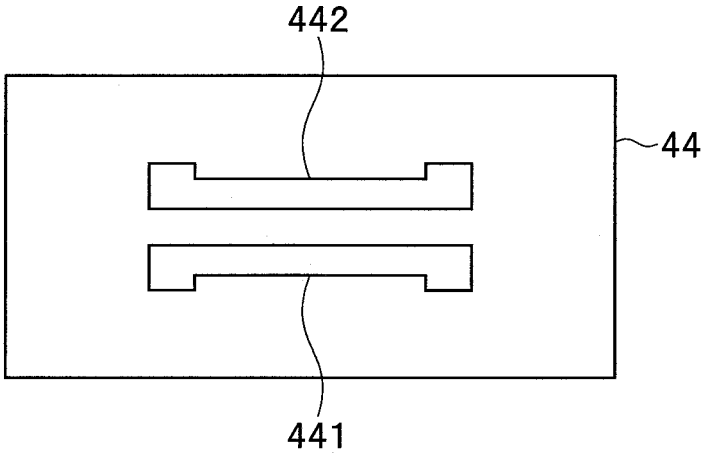
Figure 16A:
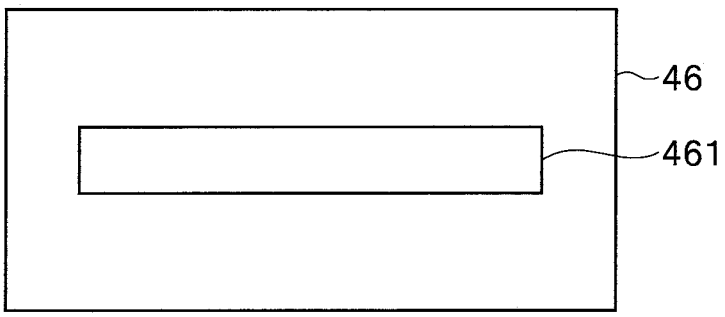
FIG. 16A and FIG. 16B are explanatory diagrams showing the respective patterned surfaces of sixth and ninth dielectric layers of the stack included in the directional coupler according to the second embodiment of the invention.
Figure 16B:
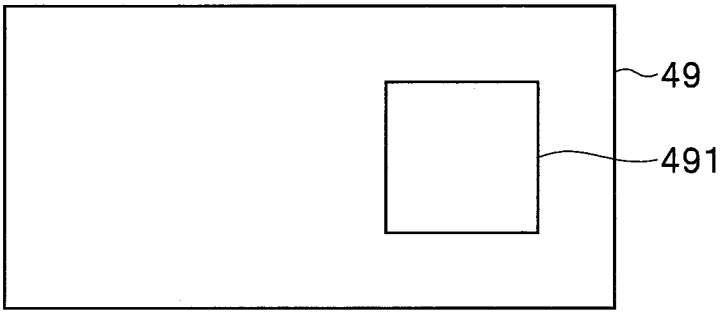

The stack 40 of the present embodiment will now be described in detail with reference to FIG. 14A to FIG. 16B. The stack 40 of the present embodiment includes nine dielectric layers stacked on top of one another. The nine dielectric layers will be referred to as the first to ninth dielectric layers in the order from bottom to top. The first to ninth dielectric layers will be denoted by the reference numerals 41 to 49. FIG. 14A shows a patterned surface of the first dielectric layer 41. FIG. 14B shows a patterned surface of the second dielectric layer 42. FIG. 15A shows a patterned surface of the third dielectric layer 43. FIG. 15B shows a patterned surface of the fourth dielectric layer 44. FIG. 16A shows a patterned surface of the sixth dielectric layer 46. FIG. 16B shows a patterned surface of the ninth dielectric layer 49.

As shown in FIG. 14A, the first to fourth terminals 11, 12, 13, and 14 and the ground terminals 15 and 16 are formed on the patterned surface of the first dielectric layer 41. Further, through holes 41T1, 41T2, 41T3, 41T4, 41T5, and 41T6 are formed in the dielectric layer 41. The through holes 41T1, 41T2, 41T3, 41T4, 41T5, and 41T6 are connected to the terminals 11, 12, 13, 14, 15, and 16, respectively.

As shown in FIG. 14B, conductor layers 421, 422, 423, and 424, and a ground conductor layer 425 are formed on the patterned surface of the second dielectric layer 42. The conductor layers 421 and 422 are used to constitute the first line 21. The conductor layers 423 and 424 are used to constitute the second line 22. The ground conductor layer 425 is used to constitute the ground conductor portion 23. Each of the conductor layers 421 to 424 has a first end and a second end opposite to each other. The through hole 41T1 formed in the first dielectric layer 41 is connected to a portion of the conductor layer 421 near the first end thereof. The through hole 41T2 formed in the dielectric layer 41 is connected to a portion of the conductor layer 422 near the first end thereof. The through hole 41T3 formed in the dielectric layer 41 is connected to a portion of the conductor layer 423 near the first end thereof. The through hole 41T4 formed in the dielectric layer 41 is connected to a portion of the conductor layer 424 near the first end thereof. The through holes 41T5 and 41T6 formed in the dielectric layer 41 are connected to the conductor layer 425.

Through holes 42T1, 42T2, 42T3, and 42T4 are formed in the dielectric layer 42. The through hole 42T1 is connected to a portion of the conductor layer 421 near the second end thereof. The through hole 42T2 is connected to a portion of the conductor layer 422 near the second end thereof. The through hole 42T3 is connected to a portion of the conductor layer 423 near the second end thereof. The through hole 42T4 is connected to a portion of the conductor layer 424 near the second end thereof.

As shown in FIG. 15A, conductor layers 431, 432, 433 and 434 are formed on the patterned surface of the third dielectric layer 43. The conductor layers 431 and 432 are used to constitute the first line 21. The conductor layers 433 and 434 are used to constitute the second line 22. Each of the conductor layers 431 to 434 has a first end and a second end opposite to each other. The through hole 42T1 formed in the second dielectric layer 42 is connected to a portion of the conductor layer 431 near the first end thereof. The through hole 42T2 formed in the dielectric layer 42 is connected to a portion of the conductor layer 432 near the first end thereof. The through hole 42T3 formed in the dielectric layer 42 is connected to a portion of the conductor layer 433 near the first end thereof. The through hole 42T4 formed in the dielectric layer 42 is connected to a portion of the conductor layer 434 near the first end thereof.

Through holes 43T1, 43T2, 43T3, and 43T4 are formed in the dielectric layer 43. The through hole 43T1 is connected to a portion of the conductor layer 431 near the second end thereof. The through hole 43T2 is connected to a portion of the conductor layer 432 near the second end thereof. The through hole 43T3 is connected to a portion of the conductor layer 433 near the second end thereof. The through hole 43T4 is connected to a portion of the conductor layer 434 near the second end thereof.

As shown in FIG. 15B, conductor layers 441 and 442 are formed on the patterned surface of the fourth dielectric layer 44. The conductor layer 441 is used to constitute the first line 21. The conductor layer 442 is used to constitute the second line 22. Each of the conductor layers 441 and 442 has a first end and a second end opposite to each other. The through hole 43T1 formed in the third dielectric layer 43 is connected to a portion of the conductor layer 441 near the first end thereof. The through hole 43T2 formed in the dielectric layer 43 is connected to a portion of the conductor layer 441 near the second end thereof. The through hole 43T3 formed in the dielectric layer 43 is connected to a portion of the conductor layer 442 near the first end thereof. The through hole 43T4 formed in the dielectric layer 43 is connected to a portion of the conductor layer 442 near the second end thereof.

Although not shown in the drawings, no conductor layer or through hole is formed on/in the fifth dielectric layer 45.

As shown in FIG. 16A, the adjustment conductor layer 461 is formed on the patterned surface of the sixth dielectric layer 46. The adjustment conductor layer 461 is not connected to any other conductor.

Although not shown in the drawing, no conductor layer or through hole is formed on/in the seventh and eighth dielectric layers 47 and 48.

As shown in FIG. 16B, a mark 491 is formed on the patterned surface of the ninth dielectric layer 49.

The stack 40 is formed by stacking the first to ninth dielectric layers 41 to 49 such that the patterned surface of the first dielectric layer 41 also serves as the bottom surface of the stack 40.

Correspondences of the components of the directional coupler 1 according to the present embodiment with the components inside the stack 40 shown in FIG. 14A to FIG. 16B will now be described. In the present embodiment, the first line 21 is constituted by using the conductor layers 421, 422, 431, 432, and 441. The portion of the conductor layer 441 near the first end thereof is connected to the first terminal 11 via the through hole 43T1, the conductor layer 431, the through hole 42T1, the conductor layer 421, and the through hole 41T1. The portion of the conductor layer 441 near the second end thereof is connected to the second terminal 12 via the through hole 43T2, the conductor layer 432, the through hole 42T2, the conductor layer 422, and the through hole 41T2.

In the present embodiment, the second line 22 is constituted by using the conductor layers 423, 424, 433, 434, and 442. The portion of the conductor layer 442 near the first end thereof is connected to the third terminal 13 via the through hole 43T3, the conductor layer 433, the through hole 42T3, the conductor layer 423, and the through hole 41T3. The portion of the conductor layer 442 near the second end thereof is connected to the fourth terminal 14 via the through hole 43T4, the conductor layer 434, the through hole 42T4, the conductor layer 424, and the through hole 41T4.

In the present embodiment, the ground conductor portion 23 is constituted by the ground conductor layer 425. The ground conductor layer 425 is connected to the ground terminal 15 via the through hole 41T5 and connected to the ground terminal 16 via the through hole 41T6.

Next, structural characteristics of the directional coupler 1 according to the present embodiment will be described. The first and second lines 21 and 22 are constituted by using the conductor layers 421 to 424, 431 to 434, 441, and 442 so that the first and second lines 21 and 22 are electromagnetically coupled to each other.

As described in the first embodiment, the first line 21 includes a first center portion 21A, a first connecting portion 21B, and a second connecting portion 21C. In the present embodiment, the first center portion 21A is constituted by the major part of the conductor layer 441. The first connecting portion 21B is constituted by another part of the conductor layer 441 and the conductor layers 421 and 431. The second connecting portion 21C is constituted by yet another part of the conductor layer 441 and the conductor layers 422 and 432. In FIG. 13, the border between the first center portion 21A and the first connecting portion 21B of the conductor layer 441 and the border between the first center portion 21A and the second connecting portion 21C of the conductor layer 441 are shown by dotted lines.

As described in the first embodiment, the second line 22 includes a second center portion 22A, a third connecting portion 22B, and a fourth connecting portion 22C. In the present embodiment, the second center portion 22A is constituted by the major part of the conductor layer 442. The third connecting portion 22B is constituted by another part of the conductor layer 442 and the conductor layers 423 and 433. The fourth connecting portion 22C is constituted by yet another part of the conductor layer 442 and the conductor layers 424 and 434. In FIG. 13, the border between the second center portion 22A and the third connecting portion 22B of the conductor layer 442 and the border between the second center portion 22A and the fourth connecting portion 22C of the conductor layer 442 are shown by dotted lines.

The conductor layers 423, 424, 433, 434, and 442 constituting the second center portion 22A, the third connecting portion 22B, and the fourth connecting portion 22C are opposed to the conductor layers 421, 422, 431, 432, and 441 constituting the first center portion 21A, the first connecting portion 21B, and the second connecting portion 21C, respectively, in a direction parallel to the Y direction. Both the conductor layer 441 constituting the first center portion 21A and the conductor layer 442 constituting the second center portion 22A are located on the patterned surface of the dielectric layer 44.

As described in the first embodiment, the second center portion 22A, the third connecting portion 22B, and the fourth connecting portion 22C are opposed to the first center portion 21A, the first connecting portion 21B, and the second connecting portion 21C, respectively, in a direction parallel to the Y direction that is a direction orthogonal to the stacking direction T. In the present embodiment, the conductor layers 423, 424, 433, 434, and 442 are opposed to the conductor layers 421, 422, 431, 432, and 441, respectively, in a direction parallel to the Y direction.

Like FIG. 4 in the first embodiment, FIG. 13 shows an imaginary straight line L1. The relationship between each of the first to fourth connecting portions 21B, 21C, 22B, and 22C and the imaginary straight line L1 is basically the same as that in the first embodiment. In particular, in the present embodiment, the closer to the first center portion 21A, the smaller the distance between the major part of the first connecting portion 21B and the imaginary straight line L1 in the direction parallel to the Y direction and the distance between the major part of the second connecting portion 21C and the imaginary straight line L1 in the direction parallel to the Y direction are. The closer to the second center portion 22A, the smaller the distance between the major part of the third connecting portion 22B and the imaginary straight line L1 in the direction parallel to the Y direction and the distance between the major part of the fourth connecting portion 22C and the imaginary straight line L1 in the direction parallel to the Y direction are.

Like the first embodiment, at least a part of each of the first to fourth connecting portions 21B, 21C, 22B, and 22C is located closer to the bottom surface of the stack 40 than the first and second center portions 21A and 22A are. In particular, in the present embodiment, each of the first to fourth connecting portions 21B, 21C, 22B, and 22C includes a plurality of parts located at respective different positions in the stacking direction T.

In the present embodiment, the conductor layer 421 constituting a part of the first connecting portion 21B, the conductor layer 422 constituting a part of the second connecting portion 21C, the conductor layer 423 constituting a part of the third connecting portion 22B, and the conductor layer 424 constituting a part of the fourth connecting portion 22C are all located on the patterned surface of the dielectric layer 42. The dielectric layer 42 is located closer to the bottom surface of the stack 40 than the dielectric layer 44 where the conductor layers 441 and 442 constituting the first and second center portions 21A and 22A are located. The conductor layer 431 constituting another part of the first connecting portion 21B, the conductor layer 432 constituting another part of the second connecting portion 21C, the conductor layer 433 constituting another part of the third connecting portion 22B, and the conductor layer 434 constituting another part of the fourth connecting portion 22C are all located on the patterned surface of the dielectric layer 43. The dielectric layer 43 is located closer to the bottom surface of the stack 40 than the dielectric layer 44 is, and at a position different from that of the dielectric layer 42 in the stacking direction T.

The ground conductor portion 23, i.e., the ground conductor layer 425 is located closer to the bottom surface of the stack 40 than the first and second center portions 21A and 22A are. The ground conductor layer 425 is located to overlap the first and second center portions 21A and 22A when seen in the stacking direction T. In the example shown in FIGS. 12 and 13, the ground conductor layer 425 does not overlap the first to fourth connecting portions 21B, 21C, 22B, and 22C when seen in the stacking direction T.

The configuration, function and effects of the present embodiment are otherwise the same as those of the first embodiment.

Third Embodiment

Figure 17:
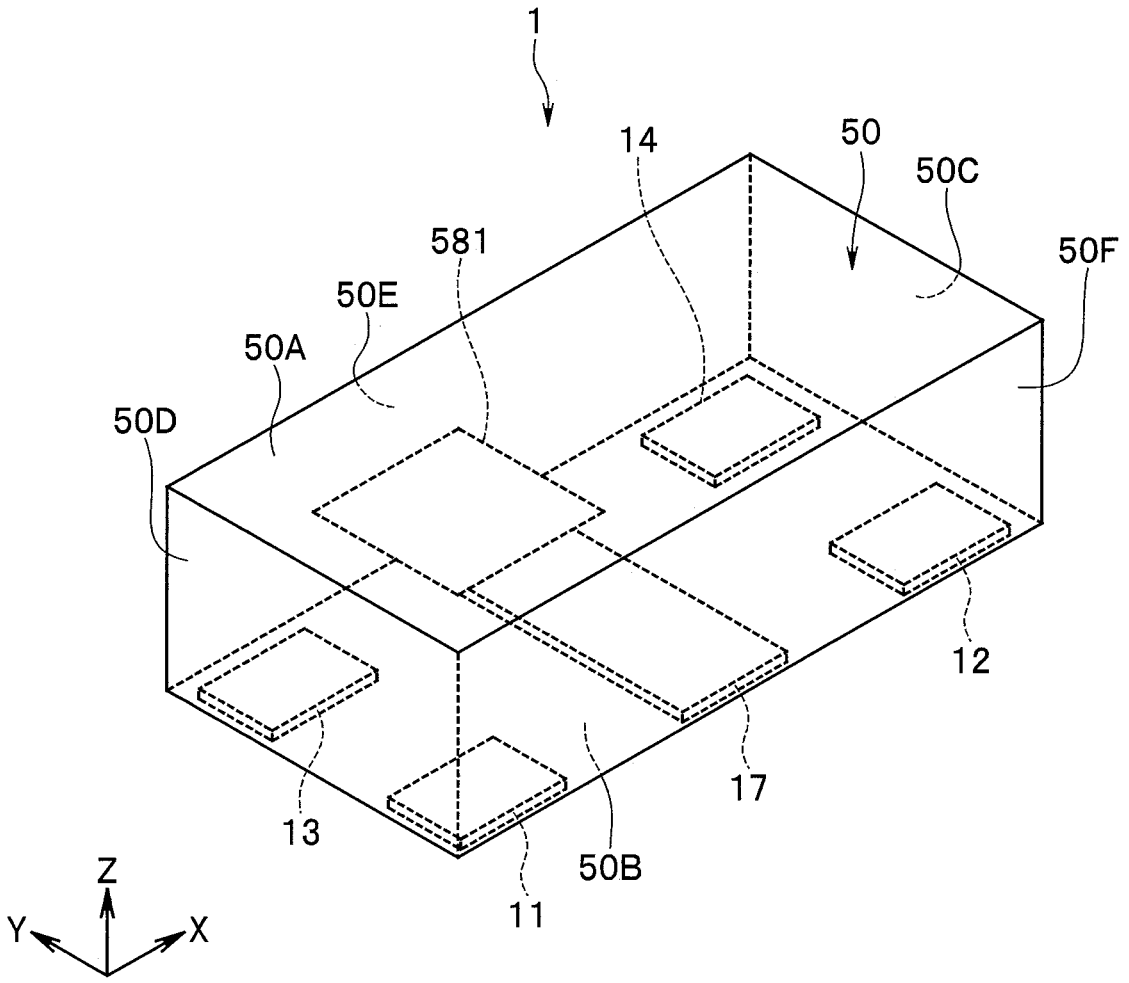
FIG. 17 is a perspective view showing the directional coupler according to a third embodiment of the invention.
Figure 18:
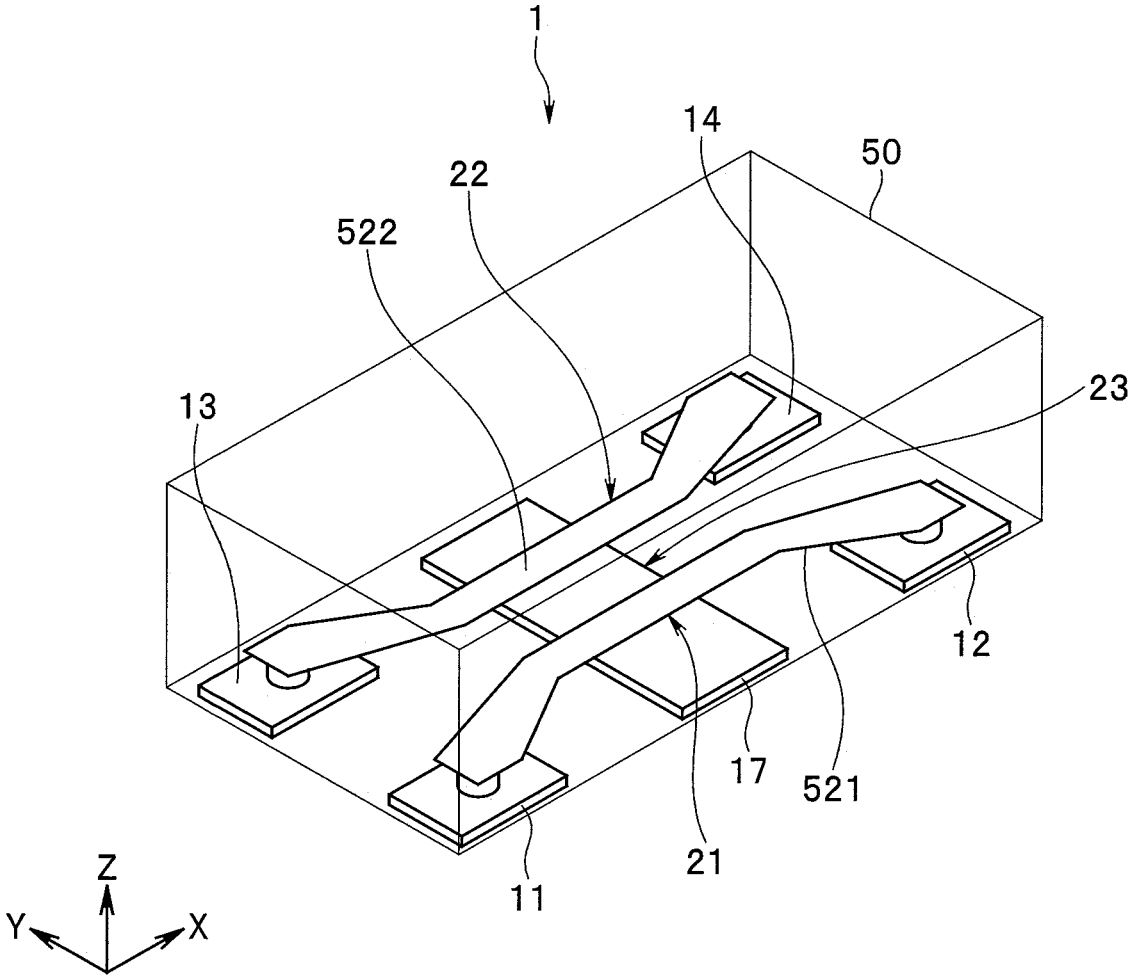
FIG. 18 is a perspective view showing principal parts of the directional coupler according to the third embodiment of the invention.
Figure 19:
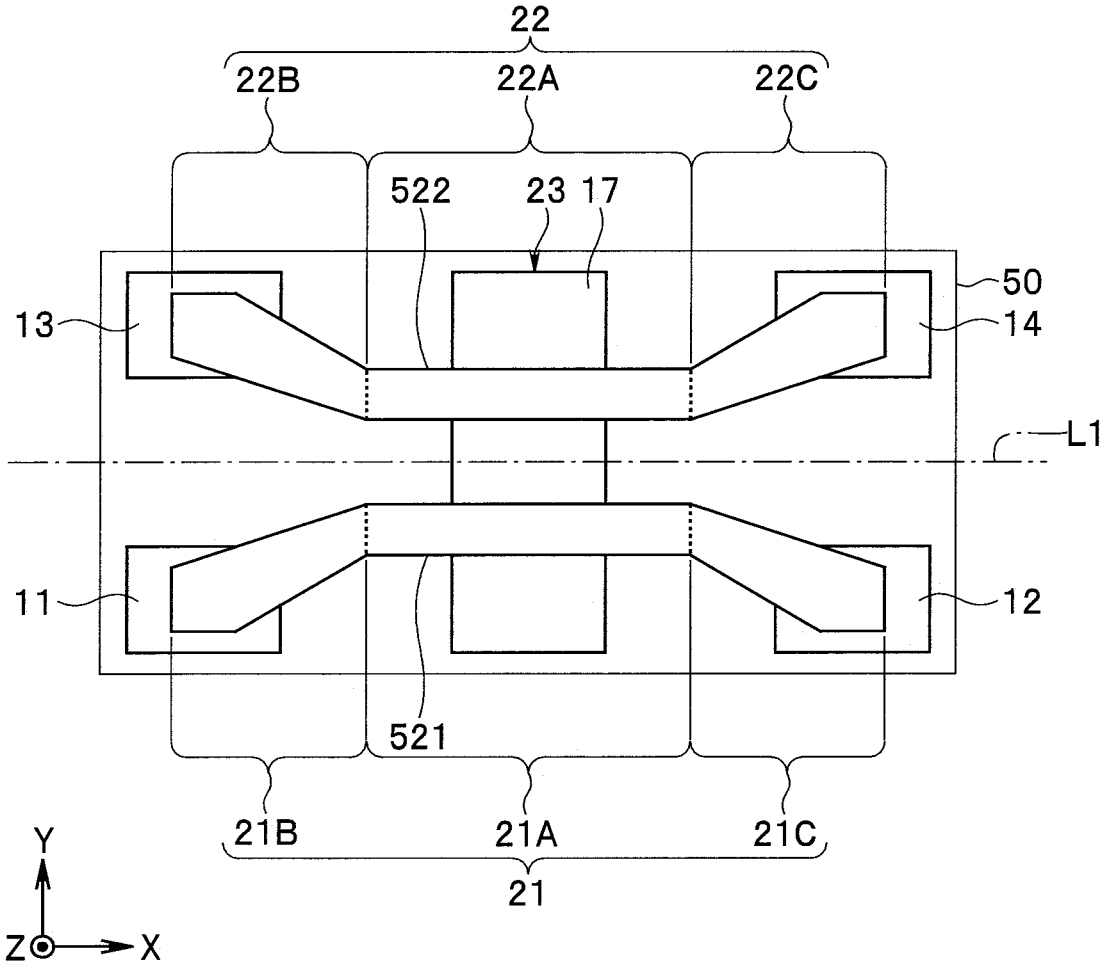
FIG. 19 is a plan view showing principal parts of the directional coupler according to the third embodiment of the invention.

A third embodiment of the invention will now be described. First, reference is made to FIG. 17 to FIG. 19 to describe the configuration of a directional coupler according to the present embodiment. FIG. 17 is a perspective view showing the directional coupler according to the present embodiment. FIG. 18 is a perspective view showing principal parts of the directional coupler according to the present embodiment. FIG. 19 is a plan view showing principal parts of the directional coupler according to the present embodiment.

Like the first embodiment, the directional coupler 1 according to the present embodiment includes first to fourth terminals 11 to 14, a first line 21, a second line 22, and a ground conductor portion 23. The directional coupler 1 according to the present embodiment includes a stack 50 instead of the stack 30 of the first embodiment. The stack 50 is intended to integrate the first to fourth terminals 11 to 14, the first line 21, the second line 22, and the ground conductor portion 23. The stack 50 includes a plurality of dielectric layers and a plurality of conductor layers stacked on each other.

The stack 50 is shaped like a rectangular solid. Like the stack 30 of the first embodiment, the stack 50 includes a top surface 50A, a bottom surface 50B, and four side surfaces 50C, 50D, 50E and 50F which constitute the outer periphery of the stack 50. The position relationship among the top surface 50A, the bottom surface 50B, and the four side surfaces 50C, 50D, 50E and 50F of the stack 50 is the same as that among the top surface 30A, the bottom surface 30B, and the four side surfaces 30C to 30F of the stack 30. FIG. 19 shows the interior of the stack 50 as seen from the top surface 50A side. The stacking direction of the plurality of dielectric layers and the plurality of conductor layers of the stack 50 will hereinafter be denoted by the symbol T.

The first to fourth terminals 11 to 14 are located on the bottom surface 50B of the stack 50. The arrangement of the first to fourth terminals 11 to 14 on the bottom surface 50B of the stack 50 is the same as that of the first to fourth terminals 11 to 14 on the bottom surface 30B of the stack 30 described in the first embodiment. The directional coupler 1 according to the present embodiment includes a ground terminal 17 located on the bottom surface 50B of the stack 50, instead of the ground terminals 15 and 16 of the first embodiment. The ground terminal 17 is connected to the ground. The ground terminal 17 has a shape long in the Y direction and is located between the first and second terminals 11 and 12 and between the third and fourth terminals 13 and 14. In the present embodiment, the ground conductor portion 23 is constituted by the ground terminal 17.

Figure 20A:
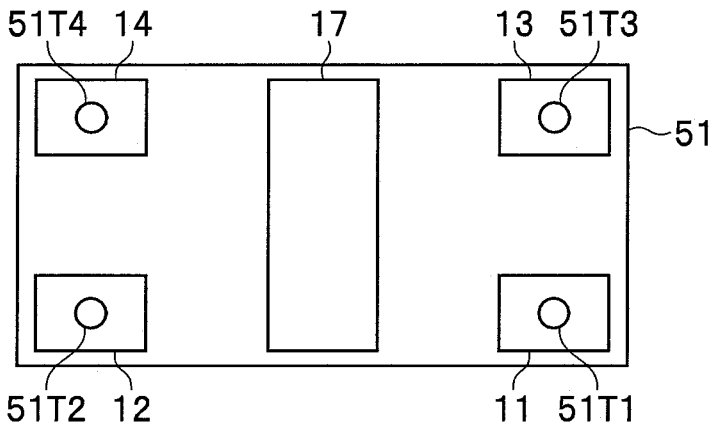
FIG. 20A and FIG. 20B are explanatory diagrams showing the respective patterned surfaces of first and second dielectric layers of a stack included in the directional coupler shown in FIG. 17.
Figure 20B:
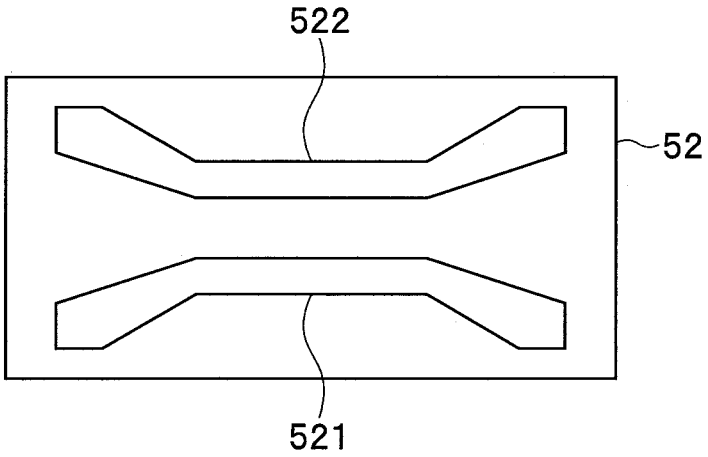
Figure 21:
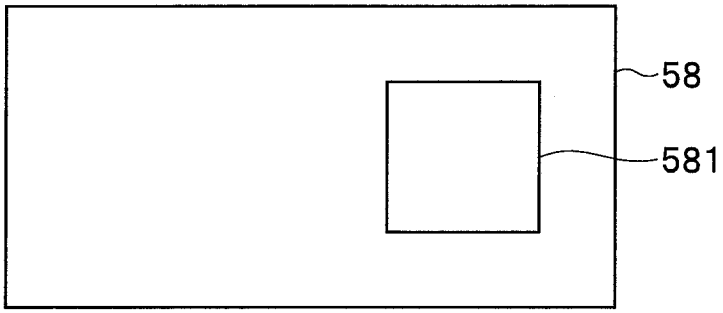
FIG. 21 is an explanatory diagram showing the patterned surface of an eighth dielectric layer of the stack included in the directional coupler shown in FIG. 17.

The stack 50 of the present embodiment will now be described in detail with reference to FIG. 20A to FIG. 21. The stack 50 of the present embodiment includes eight dielectric layers stacked on top of one another. The eight dielectric layers will be referred to as the first to eighth dielectric layers in the order from bottom to top. The first to eighth dielectric layers will be denoted by the reference numerals 51 to 58. FIG. 20A shows a patterned surface of the first dielectric layer 51. FIG. 20B shows a patterned surface of the second dielectric layer 52. FIG. 21 shows a patterned surface of the eighth dielectric layer 58.

As shown in FIG. 20A, the first to fourth terminals 11, 12, 13, and 14 and the ground terminal 17 are formed on the patterned surface of the first dielectric layer 51. Further, through holes 51T1, 51T2, 51T3, and 51T4 are formed in the dielectric layer 51. The through holes 51T1, 51T2, 51T3, and 51T4 are connected to the terminals 11, 12, 13, and 14, respectively.

As shown in FIG. 20B, conductor layers 521 and 522 are formed on the patterned surface of the second dielectric layer 52. The conductor layer 521 is used to constitute the first line 21. The conductor layer 522 is used to constitute the second line 22. Each of the conductor layers 521 and 522 has a first end and a second end opposite to each other. The through hole 51T1 formed in the first dielectric layer 51 is connected to a portion of the conductor layer 521 near the first end thereof. The through hole 51T2 formed in the dielectric layer 51 is connected to a portion of the conductor layer 521 near the second end thereof. The through hole 51T3 formed in the dielectric layer 51 is connected to a portion of the conductor layer 522 near the first end thereof. The through hole 51T4 formed in the dielectric layer 51 is connected to a portion of the conductor layer 522 near the second end thereof.

Although not shown in the drawings, no conductor layer or through hole is formed on/in the third to seventh dielectric layers 53, 54, 55, 56, and 57.

As shown in FIG. 21, a mark 581 is formed on the patterned surface of the eighth dielectric layer 58.

The stack 50 of the present embodiment is formed by stacking the first to eighth dielectric layers 51 to 58 such that the patterned surface of the first dielectric layer 51 also serves as the bottom surface 50B of the stack 50.

Correspondences of the components of the directional coupler 1 according to the present embodiment with the components inside the stack 50 shown in FIG. 20A and FIG. 20B will now be described. In the present embodiment, the first line 21 is constituted by using the conductor layer 521. The portion of the conductor layer 521 near the first end thereof is connected to the first terminal 11 via the through hole 51T1. The portion of the conductor layer 521 near the second end thereof is connected to the second terminal 12 via the through hole 51T2.

In the present embodiment, the second line 22 is constituted by using the conductor layer 522. The portion of the conductor layer 522 near the first end thereof is connected to the third terminal 13 via the through hole 51T3. The portion of the conductor layer 522 near the second end thereof is connected to the fourth terminal 14 via the through hole 51T4.

The ground conductor portion 23 is constituted by the ground terminal 17.

Next, structural characteristics of the directional coupler 1 according to the present embodiment will be described. The first and second lines 21 and 22 are constituted by using the conductor layers 521 and 522 so that the first and second lines 21 and 22 are electromagnetically coupled to each other.

As described in the first embodiment, the first line 21 includes a first center portion 21A, a first connecting portion 21B, and a second connecting portion 21C. In the present embodiment, the first center portion 21A is constituted by a part of the conductor layer 521. The first connecting portion 21B is constituted by another part of the conductor layer 521. The second connecting portion 21C is constituted by yet another part of the conductor layer 521. In FIG. 19, the border between the first center portion 21A and the first connecting portion 21B of the conductor layer 521 and the border between the first center portion 21A and the second connecting portion 21C of the conductor layer 521 are shown by dotted lines.

As described in the first embodiment, the second line 22 includes a second center portion 22A, a third connecting portion 22B, and a fourth connecting portion 22C. In the present embodiment, the second center portion 22A is constituted by a part of the conductor layer 522. The third connecting portion 22B is constituted by another part of the conductor layer 522. The fourth connecting portion 22C is constituted by yet another part of the conductor layer 522. In FIG. 19, the border between the second center portion 22A and the third connecting portion 22B of the conductor layer 522 and the border between the second center portion 22A and the fourth connecting portion 22C of the conductor layer 522 are shown by dotted lines.

The conductor layer 522 constituting the second line 22 is opposed to the conductor layer 521 constituting the first line 21 in the direction parallel to the Y direction. Both the conductor layers 521 and 522 are located on the patterned surface of the dielectric layer 52.

Like FIG. 4 in the first embodiment, FIG. 19 shows an imaginary straight line L1. The relationship between each of the first to fourth connecting portions 21B, 21C, 22B, and 22C and the imaginary straight line L1 is basically the same as in the first embodiment. In particular, in the present embodiment, the closer to the first center portion 21A, the smaller the distance between the entire first connecting portion 21B and the imaginary straight line L1 in the direction parallel to the Y direction and the distance between the entire second connecting portion 21C and the imaginary straight line L1 in the direction parallel to the Y direction are. The closer to the second center portion 22A, the smaller the distance between the entire third connecting portion 22B and the imaginary straight line L1 in the direction parallel to the Y direction and the distance between the entire fourth connecting portion 22C and the imaginary straight line L1 in the direction parallel to the Y direction are.

In the present embodiment, the first to fourth connecting portions 21B, 21C, 22B, and 22C are located at the same position as that of the first and second center portions 21A and 22A in the thickness direction T.

As described in the first embodiment, the ground conductor portion 23 is located closer to the bottom surface 50B of the stack 50 than the first and second center portions 21A and 22A are. In particular, in the present embodiment, the ground conductor portion 23 is constituted by the ground terminal 17 located on the bottom surface 50B of the stack 50. The ground terminal 17 is located to overlap the first and second center portions 21A and 22A when seen in the stacking direction T. In the example shown in FIGS. 18 and 19, the ground terminal 17 does not overlap the first to fourth connecting portions 21B, 21C, 22B, and 22C when seen in the stacking direction T.

Like the second embodiment, the plurality of conductor layers constituting the stack 50 may include an adjustment conductor layer that is capacitively coupled to the first and second center portions 21A and 22A. The configuration, function and effects of the present embodiment are otherwise the same as those of the first or second embodiment.

[Simulation]

Next, a result of a simulation made to examine a relationship between the position of the ground conductor portion 23 and the directivity will be described. First to fourth models of a directional coupler are used in the simulation. The directional coupler in the simulation includes the first to fourth terminals 11 to 14, the first line 21, the second line 22, the ground conductor portion 23, and the stack for integrating the first to fourth terminals 11 to 14, the first line 21, the second line 22, and the ground conductor portion 23 described in the first embodiment. The stack includes a plurality of dielectric layers and a plurality of conductor layers stacked on each other. The stacking direction of the plurality of dielectric layers and the plurality of conductor layers will hereinafter be denoted by the symbol T.

The first model is a model of a directional coupler where, like the directional coupler 1 according to the third embodiment, the ground conductor portion 23 is constituted by a ground terminal located on the bottom surface of the stack. In the first model, the distance between the bottom surface of the stack and the ground conductor portion 23 in the stacking direction T is 0 μm.

The second to fourth models are models of a directional coupler where, like the directional couplers 1 according to the first and second embodiments, the ground conductor portion 23 is constituted by a ground conductor layer located inside the stack. The second model is one where the ground conductor layer is formed on the patterned surface of the second dielectric layer, and the first center portion 21A of the first line 21 and the second center portion 22A of the second line 22 are formed on the patterned surface of the third dielectric layer. In the second model, the distance between the bottom surface of the stack and the ground conductor portion 23 in the stacking direction T is 40 μm.

The third model is one where the ground conductor layer is formed on the patterned surface of the third dielectric layer, and the first center portion 21A of the first line 21 and the second center portion 22A of the second line 22 are formed on the patterned surface of the fourth dielectric layer. In the third model, the distance between the bottom surface of the stack and the ground conductor portion 23 in the stacking direction T is 80 μm.

The fourth model is one where the ground conductor layer is formed on the patterned surface of the fourth dielectric layer, and the first center portion 21A of the first line 21 and the second center portion 22A of the second line 22 are formed on the patterned surface of the fifth dielectric layer. In the fourth model, the distance between the bottom surface of the stack and the ground conductor portion 23 in the stacking direction T is 120 μm.

In the simulation, the first to fourth models are each designed to have a use frequency band of 24.25 to 29.5 GHz.

Figure 22:
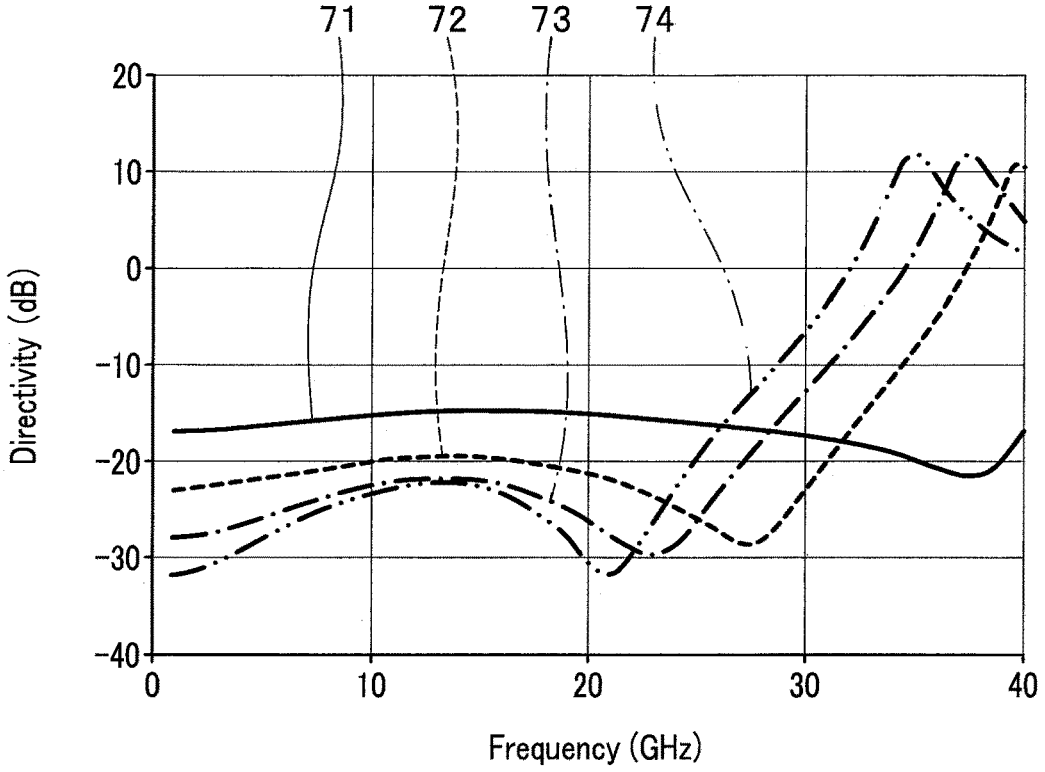
FIG. 22 is a characteristic diagram showing the frequency response of the directivity of first to fourth models determined by a simulation.

FIG. 22 is a characteristic diagram showing the frequency response of the directivity of each of the first to fourth models. In FIG. 22, the horizontal axis represents the frequency, and the vertical axis the directivity. In FIG. 22, the reference numeral 71 denotes the directivity of the first model, the reference numeral 72 the directivity of the second model, the reference numeral 73 the directivity of the third model, and the reference numeral 74 the directivity of the fourth model.

Figure 23:
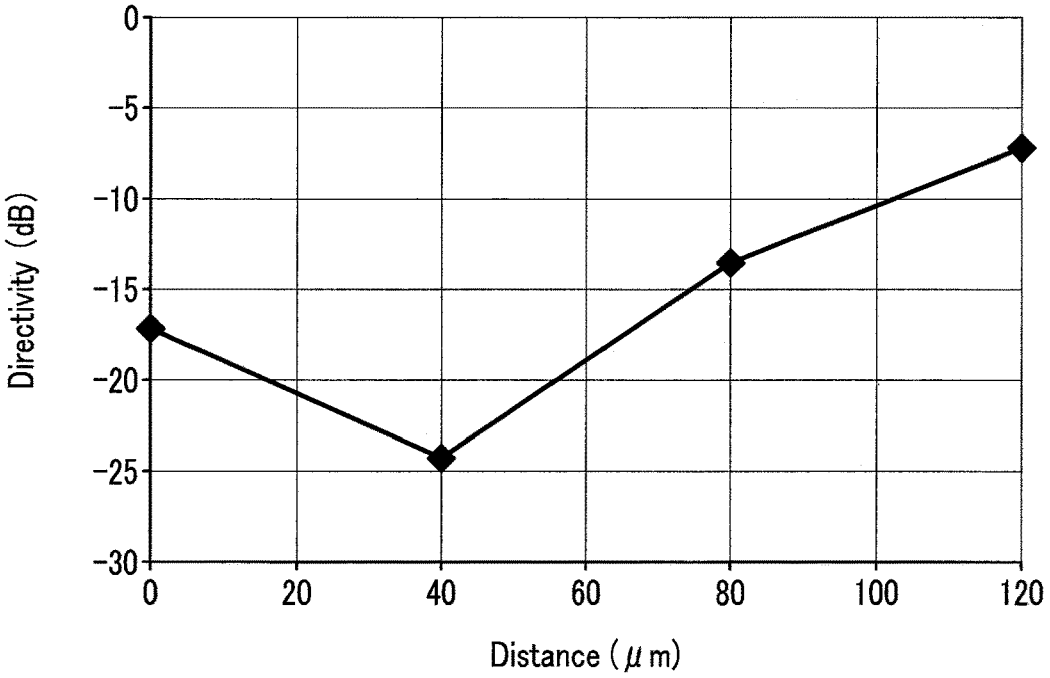
FIG. 23 is a characteristic diagram showing a relationship between the distance from the bottom surface of the stack to the ground conductor portion and the directivity determined by the simulation.

As described in the first embodiment, if the use frequency band is 24.25 to 29.5 GHz, the value of d at 29.5 GHz is preferably 10 or more, where the directivity is denoted as −d (dB). FIG. 23 is a characteristic diagram showing the directivity of each of the first to fourth models at 29.5 GHz. In FIG. 23, the horizontal axis represents the distance between the bottom surface of the stack and the ground conductor portion 23 in the stacking direction T, and the vertical axis the directivity. From FIG. 23, it can be seen that the distance between the bottom surface of the stack and the ground conductor portion 23 in the stacking direction T is preferably in the range of 0 μm or more and not more than 100 μm.

The lower limit value of the thickness of the dielectric layer is 10 μm. On the basis of FIG. 23, the distance between the bottom surface of the stack and the ground conductor portion 23 in the stacking direction T may therefore be set to 0 μm or within the range of 10 μm or more and not more than 100 μm.

The present invention is not limited to the foregoing embodiments, and various modifications may be made thereto. The shapes and arrangement of the first and second lines 21 and 22 are not limited to the examples described in the embodiments and may be freely set as long as the requirements set forth in the claims are satisfied. For example, the first and second lines 21 and 22 do not need to have symmetrical shapes. Specifically, either one of the first and second lines 21 and 22 may be entirely constituted by a conductor layer extending in the direction parallel to the X direction. Alternatively, the center portion of either one of the first and second lines 21 and 22 may have a substantially convex shape when seen in the stacking direction T, and the center portion of the other a substantially concave shape when seen in the stacking direction T.

At least either one of the first and second lines 21 and 22 may have a substantially arch-like curved shape when seen in the stacking direction T. In such a case, the entire center portion of the first or second line 21 or 22 may have a curved shape when seen in the stacking direction T. Alternatively, the center portion may include a portion of curved shape and a portion of straight shape when seen in the stacking direction T.

Obviously, many modifications and variations of the present invention are possible in the light of the above teachings. Thus, it is to be understood that, within the scope of the appended claims and equivalents thereof, the invention may be practiced in other embodiments than the foregoing most preferable embodiments.

What is claimed is:

1. A directional coupler comprising:

a first terminal;

a second terminal;

a third terminal;

a fourth terminal;

a first line that connects the first and second terminals;

a second line that connects the third and fourth terminals;

a ground conductor portion that is connected to a ground; and a stack for integrating the first to fourth terminals, the first and second lines, and the ground conductor portion, wherein the stack includes a plurality of dielectric layers and a plurality of conductor layers stacked on each other, and includes a top surface and a bottom surface located at opposite ends in a stacking direction of the plurality of dielectric layers and the plurality of conductor layers, the first and second lines are constituted by using the plurality of conductor layers so that the first and second lines are electromagnetically coupled to each other, the first line includes a first center portion including a longitudinal center of the first line, a first connecting portion connecting the first center portion and the first terminal, and a second connecting portion connecting the first center portion and the second terminal, the second line includes a second center portion including a longitudinal center of the second line, a third connecting portion connecting the second center portion and the third terminal, and a fourth connecting portion connecting the second center portion and the fourth terminal, the second center portion, the third connecting portion, and the fourth connecting portion are opposed to the first center portion, the first connecting portion, and the second connecting portion, respectively, in a first direction orthogonal to the stacking direction, the first and second center portions are located at a same position in the stacking direction, a distance between the first and third connecting portions in the first direction and a distance between the second and fourth connecting portions in the first direction decrease toward the first and second center portions, the ground conductor portion is located closer to the bottom surface of the stack than the first and second center portions are, where the ground conductor portion overlaps the first and second center portions when seen in the stacking direction, and the first to fourth terminals are located on the bottom surface of the stack.

2. The directional coupler according to claim 1, wherein a distance between the first connecting portion and an imaginary straight line in the first direction and a distance between the second connecting portion and the imaginary straight line in the first direction decrease toward the first center portion, the imaginary straight line being assumed to be orthogonal to the stacking direction and the first direction and extend to pass between the first and second center portions.

3. The directional coupler according to claim 2, wherein a distance between the third connecting portion and the imaginary straight line in the first direction and a distance between the fourth connecting portion and the imaginary straight line in the first direction decrease toward the second center portion.

4. The directional coupler according to claim 1, wherein:

the stack further includes a ground conductor layer located inside the stack; and the ground conductor portion is constituted by the ground conductor layer.

5. The directional coupler according to claim 4, wherein at least a part of each of the first to fourth connecting portions is located closer to the bottom surface of the stack than the first and second center portions are.

6. The directional coupler according to claim 5, wherein each of the first to fourth connecting portions includes a plurality of parts located at respective different positions in the stacking direction.

7. The directional coupler according to claim 1, further comprising a ground terminal located on the bottom surface of the stack, wherein the ground conductor portion is constituted by the ground terminal.

8. The directional coupler according to claim 7, wherein the first to fourth connecting portions are located at a same position as a position of the first and second center portions in the stacking direction.

9. The directional coupler according to claim 1, wherein a distance between the bottom surface of the stack and the ground conductor portion in the stacking direction falls within a range of 0 to 100 μm.

10. The directional coupler according to claim 1, wherein the stack further includes an adjustment conductor layer capacitively coupled to the first and second center portions.

* * * * *